US009195170B2

(12) United States Patent
Batori

(10) Patent No.: US 9,195,170 B2
(45) Date of Patent: Nov. 24, 2015

(54) CARTRIDGE, PROCESS CARTRIDGE AND IMAGE FORMING APPARATUS

(71) Applicant: CANON KABUSHIKI KAISHA, Tokyo (JP)

(72) Inventor: Yoshiyuki Batori, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/309,057

(22) Filed: Jun. 19, 2014

(65) Prior Publication Data

US 2014/0376969 A1 Dec. 25, 2014

(30) Foreign Application Priority Data

Jun. 24, 2013 (JP) ..... 2013-131850
Mar. 13, 2014 (JP) ..... 2014-050369

(51) Int. Cl.
*G03G 15/08* (2006.01)
*G03G 21/18* (2006.01)

(52) U.S. Cl.
CPC ..... *G03G 15/0874* (2013.01); *G03G 21/18* (2013.01)

(58) Field of Classification Search
CPC G03G 21/08; G03G 15/0874; G03G 15/0877
See application file for complete search history.

(56) References Cited

U.S. PATENT DOCUMENTS 4,647,180 A * 3/1987 Watanabe ..... 399/258
4,766,457 A * 8/1988 Barker et al. ..... 399/106
4,797,704 A * 1/1989 Williams et al. ..... 399/119
5,079,591 A * 1/1992 Tomita et al. ..... 399/262
5,148,223 A * 9/1992 Cipolla ..... 399/258
5,400,066 A * 3/1995 Matsumoto et al. ..... 347/86
5,426,492 A * 6/1995 Diehl ..... 399/262
5,655,181 A * 8/1997 Chadani et al. ..... 399/114
5,761,584 A * 6/1998 Tsuda et al. ..... 399/258
5,832,343 A * 11/1998 Kobayashi et al. ..... 399/119
5,911,096 A 6/1999 Batori et al.
5,920,753 A 7/1999 Sasaki et al.
5,930,562 A 7/1999 Noda et al.
5,937,237 A 8/1999 Nonaka et al.
5,940,658 A 8/1999 Yokoi et al.
6,075,957 A 6/2000 Batori et al.
6,101,348 A 8/2000 Nonaka et al.
6,131,007 A 10/2000 Yamaguchi et al.
6,275,668 B1 8/2001 Batori
6,334,035 B1 12/2001 Abe et al.
6,363,226 B1 3/2002 Batori et al.
6,714,746 B2 3/2004 Morioka et al.
6,937,832 B2 8/2005 Sato et al.
6,963,706 B2 11/2005 Morioka et al.
7,079,787 B2 7/2006 Ogino et al.

(Continued)

FOREIGN PATENT DOCUMENTS

JP H04-66980 3/1992

*Primary Examiner* — David Bolduc
(74) *Attorney, Agent, or Firm* — Fitzpatrick, Cella, Harper & Scinto

(57) ABSTRACT

A cartridge detachably mountable to a main assembly of an image forming apparatus includes: a frame; a flexible container, provided with an opening at a side thereof and provided inside the frame, for accommodating a developer; and a feeding member, provided below the flexible container and provided between the flexible container and the frame, for feeding the developer. The feeding member is capable of discharging the developer discharged through the opening of the flexible container into between the flexible container and the frame.

15 Claims, 20 Drawing Sheets

(56) References Cited

U.S. PATENT DOCUMENTS

| | | | | |
|---|---|---|---|---|
| 7,127,192 | B2 | 10/2006 | Batori et al. | |
| 7,136,604 | B2 | 11/2006 | Chadani et al. | |
| 7,200,349 | B2 | 4/2007 | Sato et al. | |
| 7,418,225 | B2 | 8/2008 | Morioka et al. | |
| 7,647,011 | B2 * | 1/2010 | Hayashi | 399/262 |
| 7,885,575 | B2 | 2/2011 | Batori et al. | |
| 8,081,898 | B2 | 12/2011 | Batori et al. | |
| 8,326,185 | B2 | 12/2012 | Asanuma et al. | |
| 8,406,656 | B2 | 3/2013 | Batori et al. | |
| 8,565,640 | B2 | 10/2013 | Batori et al. | |
| 8,644,732 | B2 | 2/2014 | Kikuchi et al. | |
| 8,676,085 | B1 | 3/2014 | Batori et al. | |
| 2002/0025195 | A1 * | 2/2002 | Iwata et al. | 399/258 |
| 2002/0025196 | A1 * | 2/2002 | Matsumoto et al. | 399/258 |
| 2004/0179866 | A1 * | 9/2004 | Muramatsu et al. | 399/258 |
| 2008/0219683 | A1 * | 9/2008 | Muramatsu | 399/27 |
| 2011/0064478 | A1 * | 3/2011 | Yamaguchi et al. | 399/262 |
| 2012/0177414 | A1 * | 7/2012 | Ikeguchi et al. | 399/262 |
| 2012/0219318 | A1 * | 8/2012 | Yoshida et al. | 399/110 |
| 2013/0039678 | A1 * | 2/2013 | Yoshida et al. | 399/262 |
| 2013/0136489 | A1 * | 5/2013 | Yamaguchi et al. | 399/106 |
| 2013/0164039 | A1 * | 6/2013 | Matsushita et al. | 399/258 |
| 2013/0164040 | A1 * | 6/2013 | Matsushita et al. | 399/258 |
| 2013/0308971 | A1 * | 11/2013 | Kashiide et al. | 399/106 |
| 2013/0308973 | A1 * | 11/2013 | Kashiide et al. | 399/106 |
| 2013/0308979 | A1 * | 11/2013 | Matsuzaki et al. | 399/111 |
| 2013/0322926 | A1 * | 12/2013 | Matsunaga et al. | 399/258 |
| 2013/0343785 | A1 * | 12/2013 | Matsuzaki et al. | 399/262 |
| 2014/0086620 | A1 | 3/2014 | Takeuchi et al. | |
| 2014/0086621 | A1 | 3/2014 | Makiguchi et al. | |
| 2014/0086632 | A1 | 3/2014 | Batori et al. | |
| 2014/0093272 | A1 | 4/2014 | Matsumaru et al. | |
| 2014/0105639 | A1 | 4/2014 | Kikuchi et al. | |
| 2014/0126928 | A1 | 5/2014 | Batori et al. | |
| 2014/0212166 | A1 | 7/2014 | Takeuchi et al. | |
| 2014/0212181 | A1 * | 7/2014 | Nakamura et al. | 399/258 |
| 2014/0348535 | A1 | 11/2014 | Murakami et al. | |
| 2014/0356020 | A1 | 12/2014 | Murakami et al. | |
| 2015/0003865 | A1 | 1/2015 | Batori et al. | |

* cited by examiner (a)

(b)

(a)

(b)

(a)

(b)

CARTRIDGE, PROCESS CARTRIDGE AND IMAGE FORMING APPARATUS

FIELD OF THE INVENTION AND RELATED ART

The present invention relates to a cartridge for accommodating a developer, a process cartridge and an image forming apparatus to which the process cartridge is detachably mountable.

A developing device refers to a device, including a developer carrying member, for visualizing an electrostatic image with a developer.

Example of the cartridge may include a developing cartridge and the process cartridge. The process cartridge is prepared by integrally assembling an image bearing member and an actable means actable on the image bearing member into a cartridge (unit), which is detachably mountable to an apparatus main assembly of the image forming apparatus.

The image forming apparatus forms an image no a recording material (medium) by using an electrophotographic image forming type (process). Examples of the image forming apparatus may include an electrophotographic copying machine, an electrophotographic printer (LED printer, laser beam printer or the like), a facsimile machine, a word processor and so on.

Japanese Laid-Open Patent Application (JP-A) Hei 4-66980 discloses a constitution in which a flexible container is provided inside a frame of a cartridge and in which a developer is accommodated in the flexible container.

However, in the constitution of JP-A Hei 4-66980, the developer enters between the flexible container and the frame after being discharged from the flexible container, so that there is a possibility that a part of the developer cannot be fed to a developing roller.

SUMMARY OF THE INVENTION

The present invention has been accomplished in view of the above circumstances. A principal object of the present invention is to provide a cartridge capable of satisfactorily discharging a developer in the case where the developer enters between a flexible container and a frame.

According to an aspect of the present invention, there is provided a cartridge detachably mountable to a main assembly of an image forming apparatus, comprising: a frame; a flexible container, provided with an opening at a side thereof and provided inside the frame, for accommodating a developer; and a feeding member, provided below the flexible container and provided between the flexible container and the frame, for feeding the developer, wherein the feeding member is capable of discharging the developer discharged through the opening of the flexible container into between the flexible container and the frame.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments for carrying out the present invention will be specifically described with reference to the drawings. Dimensions, materials, shapes and relative positions of constituent elements described in the following embodiment should be appropriately be changed depending on structures and various conditions of devices (apparatuses) to which the present invention is applied. Accordingly, the scope of the present invention is not intended to be limited to the following embodiments unless otherwise specified.

[Embodiment 1]

Figure 1:
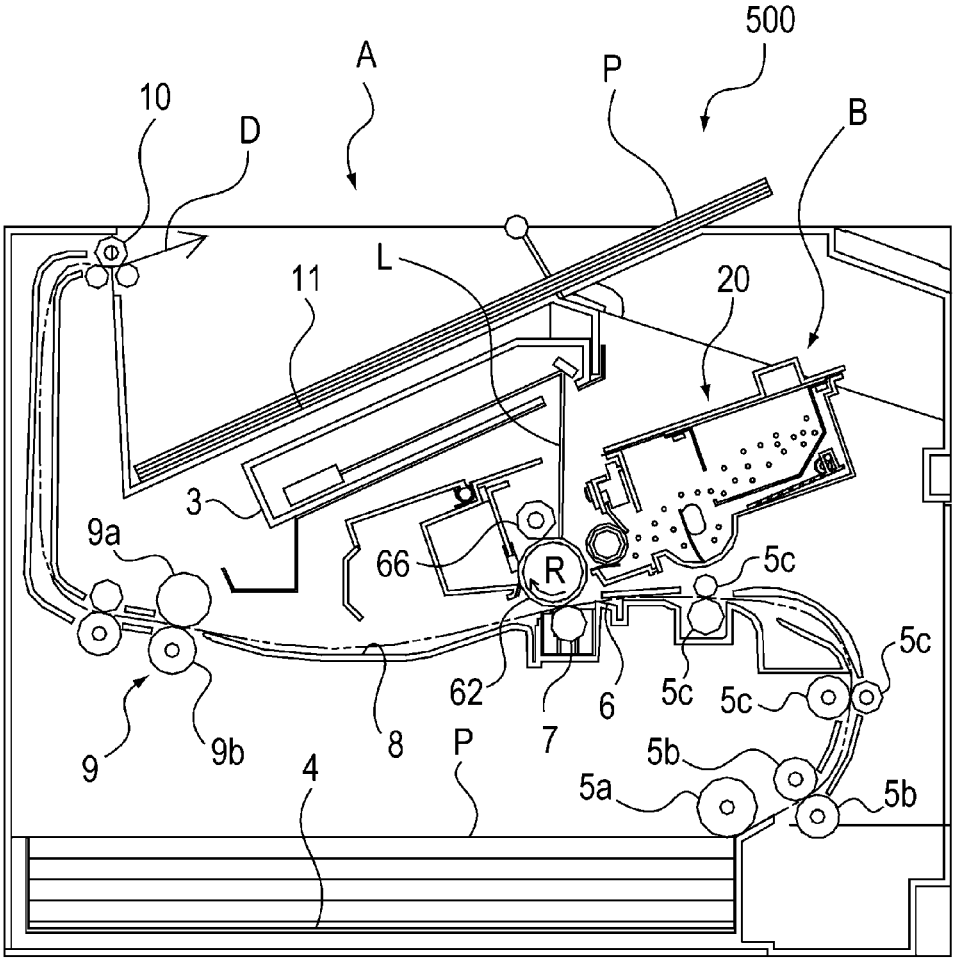
FIG. 1 is a sectional view of an image forming apparatus in Embodiment 1.

FIG. 1 is a sectional view of an image forming apparatus 500 in this embodiment. As shown in FIG. 1, the image forming apparatus 500 includes an apparatus main assembly A. Inside the apparatus main assembly A, photosensitive drum 62 as an image bearing member is provided. At a periphery of the photosensitive drum 62, a charging roller 66, an exposure device 3, a developing unit 20 and a transfer roller 7 are provided. The photosensitive drum 62, the charging roller 66 and the developing unit 20 are constituted as a cartridge B (process cartridge or developing cartridge). The cartridge B is detachably mountable to the apparatus main assembly A.

Further, inside the apparatus main assembly A, a tray 4 in which a sheet P as a recording material (medium) is accommodated is provided. The sheet P passes along a feeding direction D through a pick-up roller 5*a*, a feeding roller pair 5*b*, a conveyance roller pair 5*c*, a transfer guide 6, a nip between the photosensitive drum 62 and the transfer roller 7, a feeding guide 8 and a fixing device 9 and then is discharged onto a tray 11 through a discharging roller pair 10. The fixing device 9 includes a heating roller 9*a* and a pressing roller 9*b*.

The surface of the photosensitive drum 62 is electrically charged uniformly by the charging roller 66, and then an electrostatic image is formed by laser light L emitted from the exposure device 3. Thereafter, the electrostatic image is developed with a developer into a developer image by the developing unit 20. On the other hand, the sheet P placed in the tray 4 is fed from the pick-up roller 5*a* and then is conveyed to a transfer nip between the photosensitive drum 62 and the transfer roller 7. Here, onto the sheet P, the developer image is transferred from the photosensitive drum 62. Thereafter, on the sheet P, the developer image is fixed by the fixing device 9, thus enabling image formation and image fixing.

Figure 2:
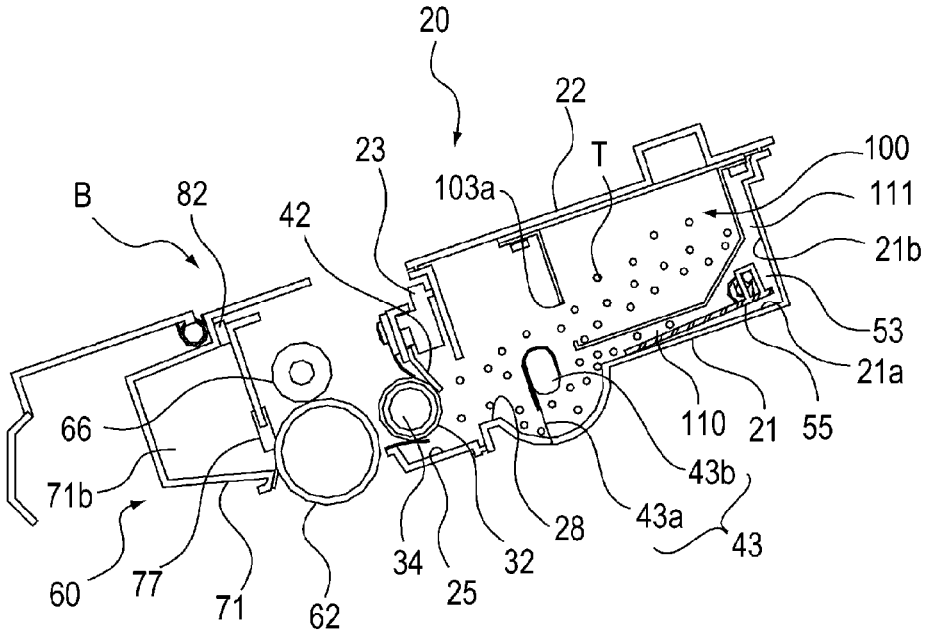
FIG. 2 is a sectional view of a cartridge.

FIG. 2 is a sectional view of the cartridge B. As shown in FIG. 2, the cartridge B includes the developing unit 20 and a cleaning unit 60. The developing unit 20 includes an accommodating container 21, a cover 22 and a developing (device) frame 23. Inside the accommodating container 21, the cover 22 and the developing frame 23, a developing chamber 25 and a toner chamber 26 are defined. Inside the toner chamber 26, a developer bag 100 is provided. Inside the developer bag 100, a developer T is accommodated. A bottom 21*a* as a bottom surface of the accommodating container 21 is set so as to be higher in a side remote from a discharge opening 103*a* than in a side close to the discharge opening 103*a*.

Inside the toner chamber 26, an actable member 43 is rotatably mounted. When the actable member 43 is rotated, the developer T in the toner chamber 26 is fed to a developing chamber 25 while being stirred. The actable member 43 includes a sheet member 43*a*. This sheet member 43*a* is formed in a sheet shape of a flexible material such as PPS, PC or PET.

Inside the developing chamber 25, a developing roller 32 is rotatably mounted. The developing roller 32 as a developer carrying member includes a magnet roller 34 therein and carries the developer T at a surface thereof by a magnetic force. When the developing roller 32 is rotated, the developer T in the developing chamber 25 is moved toward the photosensitive drum 62 by the developing roller 32. The developing chamber 25 of the accommodating container 21 is provided with an opening where a developing blade 42 is mounted. The developing blade 42 is contacted to the developing roller 32 and regulates a thickness of a layer of the developer T formed at the surface of the developing roller 32.

Next, the cleaning unit 60 includes therein the photosensitive drum 62, the charging roller 66 and a residual toner chamber 71*b*. The residual toner chamber 71*b* is provided with a cleaning blade 77. A residual toner on the surface of the photosensitive drum 62 is removed by the cleaning blade 77 and then is used again in the image forming process. The toner removed from the photosensitive drum 62 is stored in the residual toner chamber 71*b*.

Figure 3:
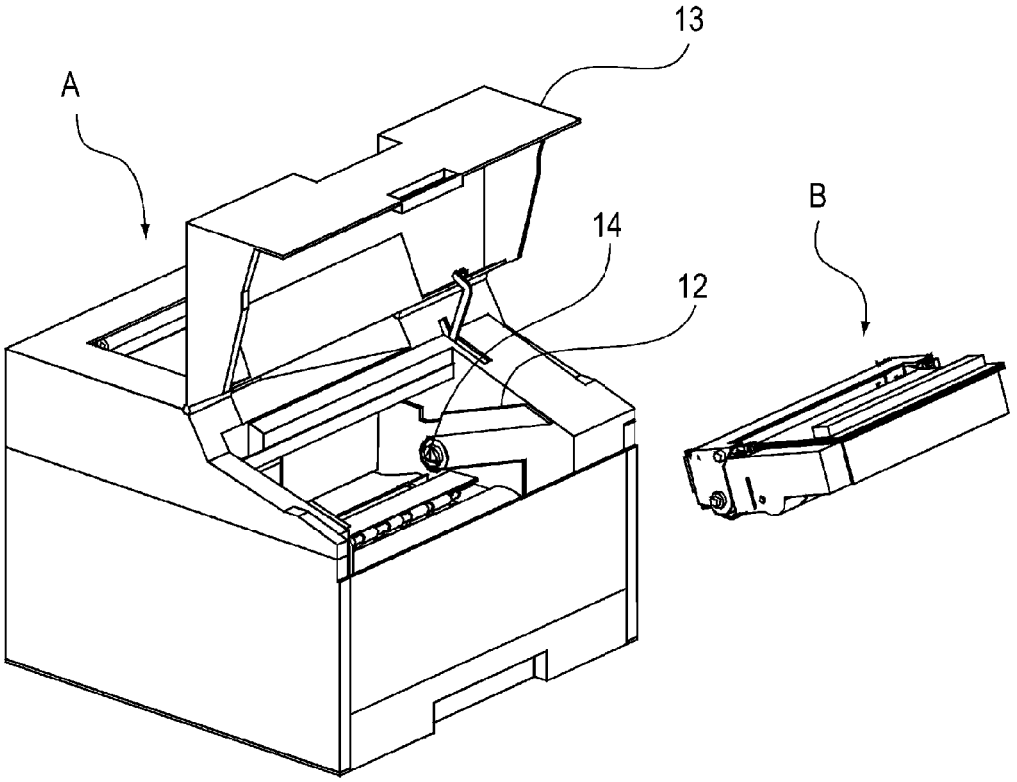
FIG. 3 is a perspective view of an apparatus main assembly and the cartridge.

FIG. 3 is a perspective view of the apparatus main assembly A and the cartridge B. As shown in FIG. 3, the apparatus main assembly A is provided with a door 13 rotatably. On a side wall in the inside of the apparatus main assembly A, a guide rail 12 is formed, and at a rear end of the guide rail 12, a driving shaft 14 is provided. In the case where the cartridge B is mounted in the apparatus main assembly A, a shaft of the photosensitive drum 62 of the cartridge B is guided toward a rear side along the guide rail 12 and then is engaged with the driving shaft 14.

Figure 5:
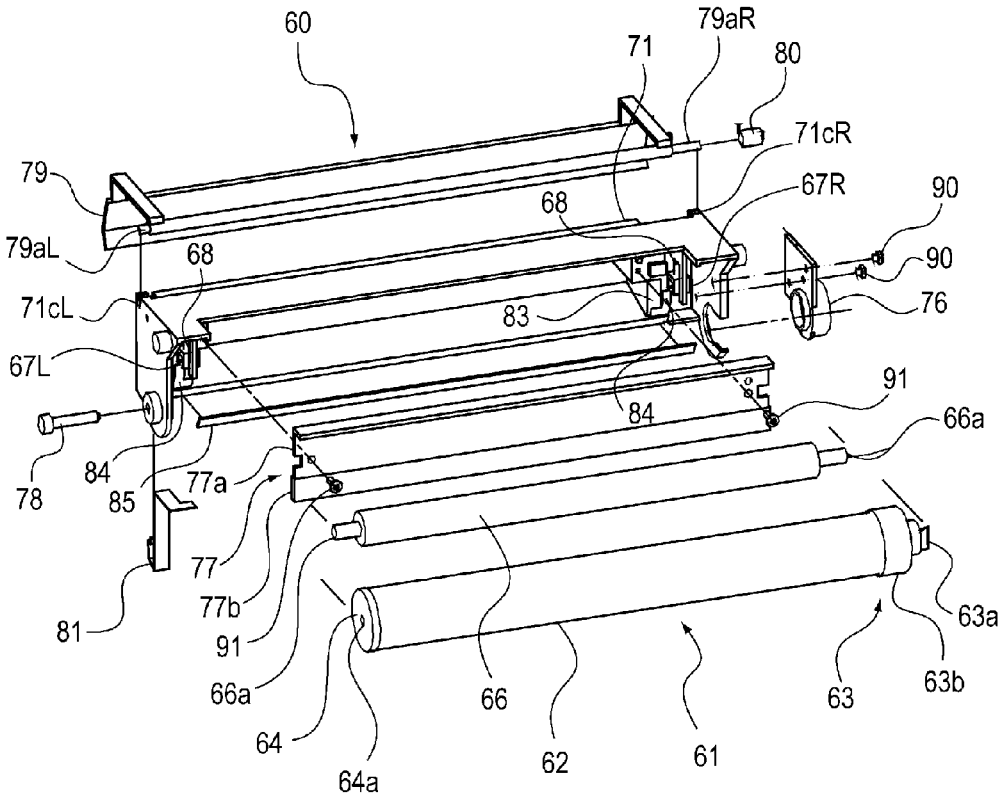
FIG. 5 is an exploded perspective view of the cartridge.

Although described later, the driving shaft to be driven by an unshown motor of the apparatus main assembly A engages with a driving force receiving portion 63*a* (FIG. 5). Then, to the driving force receiving portion 63*a*, the photosensitive drum 62 is connected, and thus the photosensitive drum 62 is rotated by receiving a driving force from the apparatus main assembly A. Incidentally, the charging roller 66 and the developing roller 32 are supplied with electric power from an electric power supplying portion (not shown) of the apparatus main assembly A.

Figure 4:
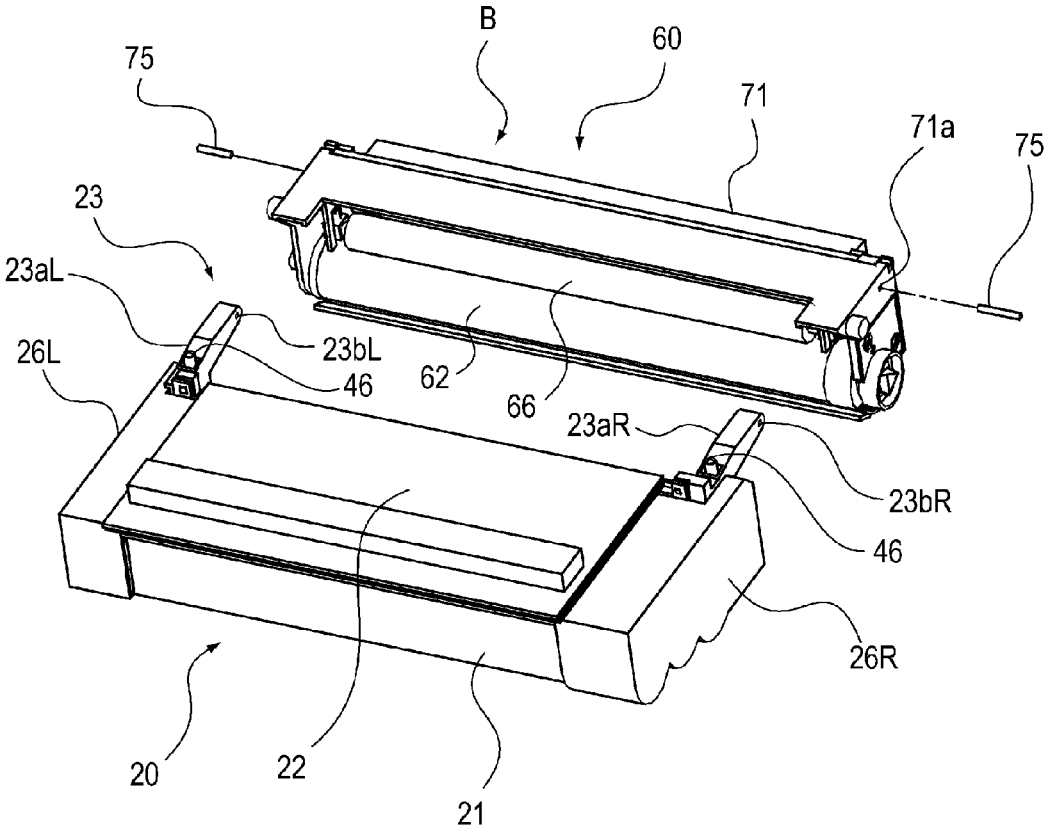
FIG. 4 is an exploded perspective view of the cartridge.

FIG. 4 is an exploded perspective view of the cartridge B. As shown in FIG. 4, the cartridge B is constituted by combining the developing unit 20 and the cleaning unit 60. The developing unit 20 includes the accommodating container 21, the cover 22, the developing frame 23, a first side member 26L and a second side member 26R. This developing unit 20 is further provided with the developing blade 42, the developing roller 32, the magnet roller 34, the actable member 43 and the developer bag 100 which are described with reference to FIG. 2 and is provided with a spring 46 shown in FIG. 4. The cleaning unit 60 includes a frame 71, the photosensitive drum 62, the charging roller 66 and the cleaning blade 77 (FIG. 2). The cleaning unit 60 and the developing unit 20 are rotationally movably connected with each other by connecting members 75 to constitute the cartridge B.

Specifically, the developing unit 20 includes arm portions 23*a*L and 23*a*R, constituting the developing frame 23, at longitudinal end portions of the developing unit 20. At free end portions of the arm portions 23*a*L and 23*a*R, rotation holes 23*b*L and 23*b*R penetrating in a direction parallel to an axial direction of the developing roller 32 are formed. Further, at each of longitudinal end portions of the frame 71, an engaging hole 71*a* for being engaged with a pin-like connecting member 75 is formed. Then, when the rotation holes 23*b*L and 23*b*R and the engaging hole 71*a* are positionally aligned with each other and the connecting members 75 are inserted into the rotation holes 23*b*L and 23*b*R and the engaging holes 71*a*, the cleaning unit 60 and the developing unit 20 are connected rotatably about the connecting members 75.

At this time, springs 46 mounted at base portions of the arm portions 23*a*L and 23*a*R contact the frame 71, so that the springs 46 urge the developing unit 20, about the connecting members 75 as a rotation center, toward the cleaning unit 60. As a result, the developing roller 32 is pressed toward the photosensitive drum 62 with reliability. Then, by gap (spacing) holding members 38 (FIG. 6) mounted at end portions of the developing roller 32, the developing roller 32 is held with a predetermined gap from the photosensitive drum 62.

FIG. 5 is an exploded perspective view of the cartridge B. As shown in FIG. 5, the cartridge bottom includes the cleaning blade 77. The cleaning blade 77 includes a supporting member 77*a* formed with a metal plate and an elastic member 77*b* formed of an elastic material such as urethane rubber. The supporting member 77*a* is disposed in a predetermined position relative to the frame 71 by being fixed with screws 91 at end portions thereof.

The elastic member 77*b* contacts the photosensitive drum 62 to remove the residual toner from the surface of the photosensitive drum 62. The removed residual toner T is stored in the residual toner chamber 71*b* (FIG. 1) of the cleaning unit 60.

A first seal member 82 (FIG. 2), a second seal member 83, a third seal member 84 and fourth seal member 85 are fixed to the frame 71 at predetermined positions by a double-side tape or the like. The first seal member 82 is provided over the longitudinal direction of the cartridge B to prevent the residual toner from leaking out from the rear surface side of the supporting member 77*a* of the cleaning blade 77. The second seal member 83 prevents the residual toner from leaking out from the longitudinal end portions of the elastic member 77*b* of the cleaning blade 77. The third seal member 84 wipes off a deposited matter such as the toner on the surface of the photosensitive drum 62 while preventing the leaking out of the residual toner from the longitudinal end portions of the elastic member 77*b* of the cleaning blade 77. The fourth seal member 85 is provided in contact with the photosensitive drum 62 over the longitudinal direction of the photosensitive drum 62 to prevent the residual toner from leaking out from an upstream side of the cleaning blade 77 with respect to the rotational direction of the photosensitive drum 62.

An electrode plate 81, urging members 68 and bearings 67L and 67R are mounted to the frame 71. A shaft portion 66*a* of the charging roller 66 is engaged into the bearings 67L and 67R. The charging roller 66 is urged against the photosensitive drum 62 by the urging members 68 and is also rotatably supported by the bearings 67L and 67R. Then, the charging roller 66 is rotated by rotation of the photosensitive drum 62.

Incidentally, the electrode plate 81, the urging members 68 and the bearings 67L and 67R have electroconductivity. The electrode plate 81 contacts an unshown electric power supplying portion of the apparatus main assembly A. These members constitute an electric power supplying path to supply the electric power to the charging roller 66.

The photosensitive drum 62 is integrally connected with flanges 63 and 64 to constitute a photosensitive drum unit 61. As a connecting method, caulking, bonding, welding or the like is used. To the flange 64, an unshown grounding contact or the like is connected. Further, the flange 63 includes a driving force receiving portion 63*a* for receiving the driving force from the apparatus main assembly A and a flange gear portion 63*b* for transmitting the driving force to the developing roller 32.

A bearing member 76 is integrally fixed to the frame 71 with screws 90 in the driving side of the frame 71, and a drum shaft 78 is press-fitted and fixed into the frame 71 in the non-driving side of the frame 71. Further, the bearing member 76 is engaged with the flange 63, and the drum shaft 78 is engaged in a hole 64*a* of the flange 64. As a result, the photosensitive drum unit 61 is rotatably supported by the frame 71.

A protective member 79 is rotatably supported by the frame 71 so that the photosensitive drum 62 can be protected (light-blocked) and exposed. An urging member 80 is mounted to a shaft portion 79*a*R of the protective member 79 in the driving side and urges the protective member 79 in a direction of protecting the photosensitive drum 62. A driving-side shaft portion 79*a*L and the non-driving-side shaft portion 79*a*R of the protective member 79 are engaged with bearing portions 71*c*L and 71*c*R of the frame 71.

Figure 6:
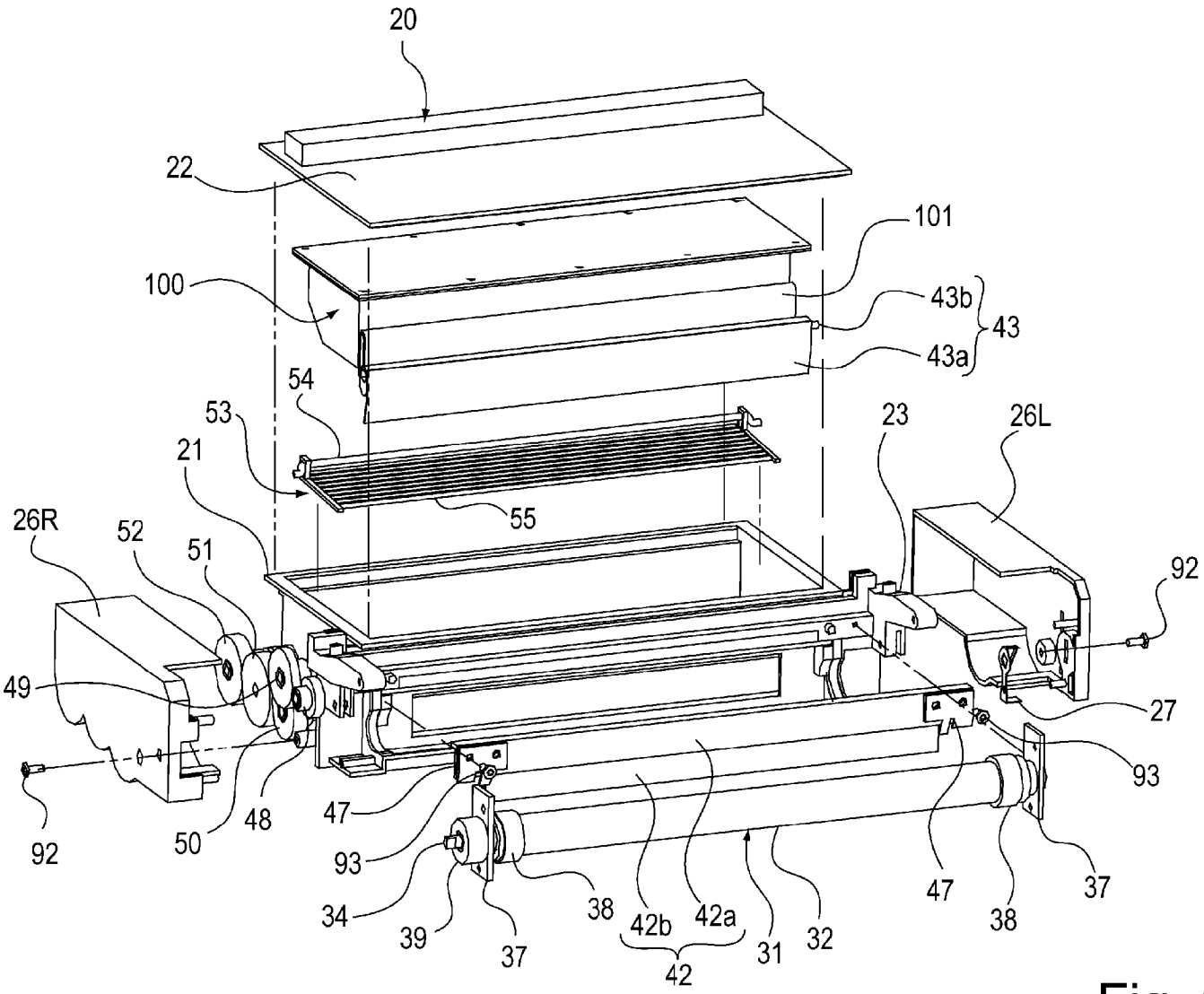
FIG. 6 is an exploded perspective view of a developing unit.

FIG. 6 is an exploded perspective view of the developing unit 20. As shown in FIG. 6, a developing (device) frame including the accommodating container 21, the cover 22 and the developing container 23 constitutes the developing chamber 25 (FIG. 1) in which the toner bag 100 is accommodated, and the toner chamber 28 (FIG. 1). The accommodating container 21, the cover 22 and the developing frame 23 which constitutes the frame are integrally connected with each other by a welding means or the like. The developer bag 100 contains the toner T and is fixed to an end of a seal member 101. The other end of the seal member 101 is fixed to the actable member 43. Further, the developer bag 100 is fixed to the cover 22.

The actable member 43 is supported by the accommodating container 21 in the non-driving side, and is supported by a feeding gear 50 mounted to the accommodating container 21 in the driving side. As a result, the actable member 43 is rotated in the toner chamber 28 by receiving the rotational force of the feeding gear 50.

A rotatable member 54 is supported by the accommodating container 21 in the non-driving side, and is supported by a feeding gear mounted to the accommodating container 21 in the driving side. As a result, the rotatable member 54 is rotated inside the toner chamber 28 by receiving the driving force of the feeding gear 52. A feeding member 53 includes the rotatable member 54 and a swingable member 55.

The developing blade 42 is constituted by a supporting member 42*a* formed with a metal plate and an elastic member 42*b* formed of an elastic material such as an urethane rubber. The elastic member 42*b* and a cleaning member 47 are fixed together with screws 93 at end portions of the supporting members 42*a*, thus being fixed to the developing frame 23. The elastic member 42*b* contacts the surface of the developing roller 32, and imparts triboelectric charges to the developer T while regulating a developer actable at the surface of the developing roller 32. The cleaning member 47 contacts the surface of the developing roller 32 at each of the longitudinal end portions of the developing roller 32, so that the deposited matter such as the developer T is removed.

A developing roller unit 31 includes the developing roller 32, the magnet roller 34, the flange 35, the gap holding member 38, a bearing member 37, a developing roller gear 39 and the like. From an end portion of the developing roller 32 in the non-driving side, the magnet roller 34 is inserted, and at the end portion, the flange 35 is press-fitted and fixed. In the flange 35, an unshown electroconductive electrode wire is incorporated, and the electrode wire contacts the developing roller 32 and an electrode plate 27.

The electrode plate 27 having electroconductivity is fixed on the first side member 26L. The electrode plate 27 contacts and supplies electric power to an unshown electric power supplying portion in the apparatus main assembly A, so that a bias voltage is applied, to the developing roller 32, from the electric power supplying portion of the apparatus main assembly A through the electrode plate 27 and an electrode wire as an electric power supplying path.

The gap holding member 38 is mounted at each of the longitudinal end portions of the developing roller 32. Outside the gap holding member 38, the bearing member 37 is disposed, and in the driving side, the developing roller gear 39 is incorporated outside the bearing member 37. The developing roller 32 is rotatably supported by the bearing member 37 disposed at each of the end portions of the developing roller 32.

First and second gears 48 and 49 as a drive transmission member are rotatably mounted to the developing frame 23. As a result, the driving force received from the apparatus main assembly A is transmitted by successive engagement of the flange gear portion 63*b* (FIG. 5), the developing roller gear 39, the first and second gears 48 and 49, the feeding gear 50, a third gear 51 and the feeding gear 52. Then, the driving force is transmitted to the developing roller 32 and the actable member 43 and then is transmitted to the feeding member 53.

The first and second side members 26L and 26R are fixed with screws 92 to the developing frame 23 at the longitudinal end portions. At that time, the bearing members 37 of the developing roller unit 31 are held by the first and second side members 26L and 26R.

Figure 7:
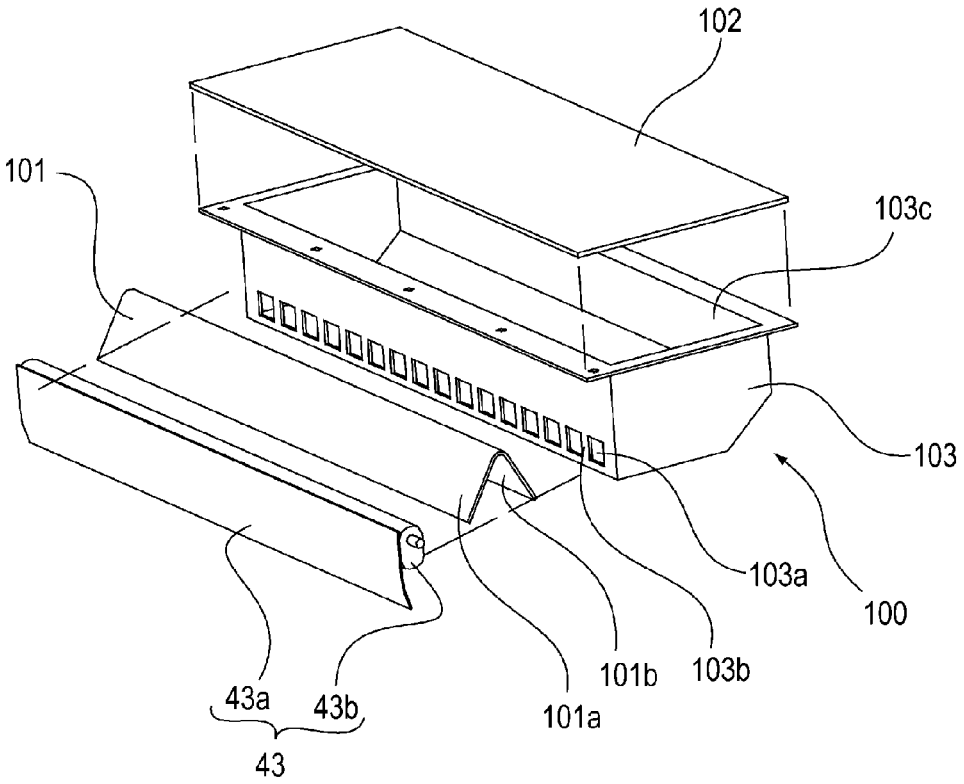
FIG. 7 is an exploded perspective view of a developer bag.
Figure 8:
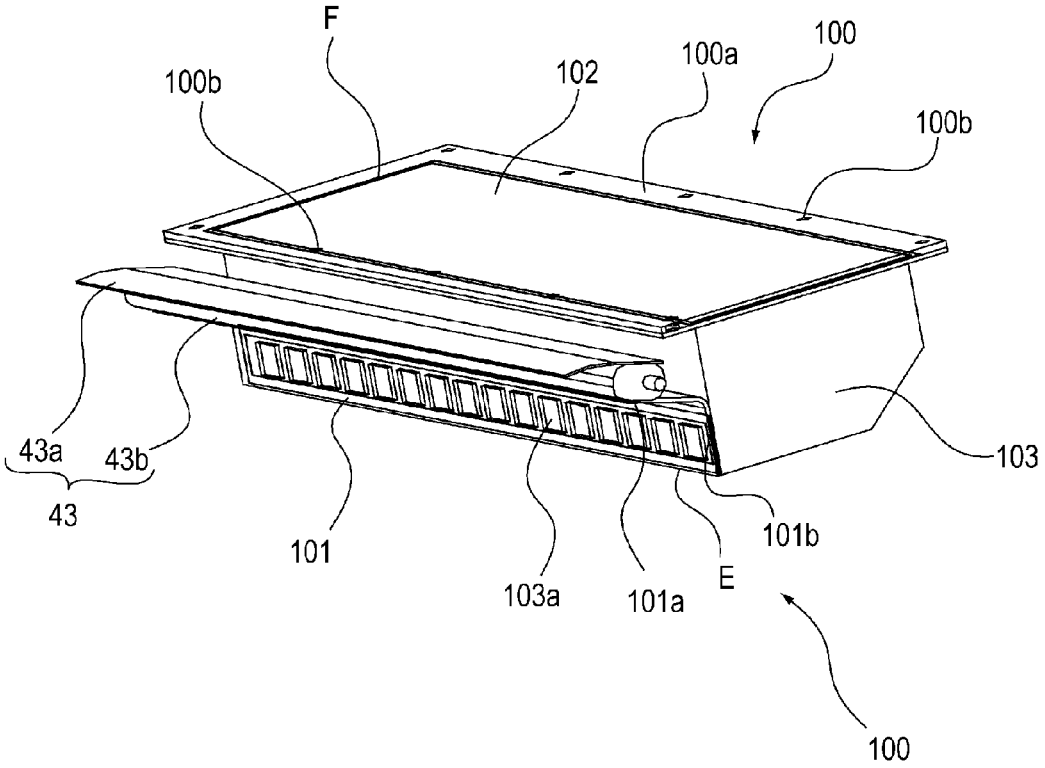
FIG. 8 is an assembling perspective view of the developer bag.

FIG. 7 is an exploded perspective view of the developer bag 100. FIG. 8 is an assembling perspective view of the developer bag 100. As shown in FIG. 7, the developer bag 100 as a flexible container includes the accommodating member 103, the seal member 102 and the sealing member 101.

The flexible container may also refers to the accommodating member 103 alone, a combination of the accommodating member 103 and the seal member 102, and a combination of the accommodating member 103, the seal member 102 and the sealing member 101. Such a developer bag 100 is disposed inside the accommodating container 23 and the cover 22, and contains therein the developer T and has flexibility.

The accommodating member 103 is formed by subjecting a sheet-like material to vacuum molding, air-pressure molding, press molding or the like. The accommodating member 103 is provided with discharge holes 103*a* as an opening for permitting discharge of the accommodated developer T. The discharge holes 103*a* are partitioned by a plurality of connecting portions 103*b* provided along the longitudinal direction of the accommodating member 103. The sealing member 101 is provided with a sealing portion 101*b* for covering the discharge holes 103*a* of the accommodating member 103 and is provided with a fixing portion 101*a* to be fixed to a shaft 43*b* of the actable member 43 functioning as an unsealing means.

As shown in FIG. 8, the sealing portion 101*b* of the sealing member 101 is (thermally) welded so as to cover a whole of the discharge holes 103*a* of the accommodating member 103, thus sealing the discharge holes 103*a* (region E in the figure). In this embodiment, as a material for the sealing member 101, a laminate material having a special sealant layer which exhibits an easy peeling property (easy-to-peel property such that peeling strength is about 3N/15 mm to about 10N/15 mm in testing methods for heat sealed flexible package according to JIS-Z0238) is used. Further, as a material for the accommodating member 103, a flexible material which is weldable with the special sealant layer is used, so that it is possible to provide the easy peeling property at the thermal welding portion.

The discharge holes 103*a* of the accommodating member 103 are sealed by the sealing portion 101*b* of the sealing member 101, and thereafter the developer T is filled in the accommodating member 103 through openings 103*c* (FIG. 7). When the developer T is filled, a known auger-type filling device is used, but a filling method (means) having a similar function may also be used.

In a state in which the accommodating member 103 and the sealing member 101 are bonded to each other, the developer T is filled, and then the seal member 102 is (thermally) welded at a periphery of the openings 103*c* so as to seal the openings 103*c* (region F in FIG. 8). The seal member 102 is a flexible sheet member, and is provided with minute holes through which air is permeable. As described above, when the developer bag 100 in which the developer T is filled is prepared, the flange portion 100*a* provided at the periphery of the developer bag 100 is provided with a plurality of fixing holes 100*b*.

On the other hand, the fixing portion 101*a* of the sealing member 101 is fixed to the actable member 43. As a fixing means thereof, it is possible to use a means, other than the thermal welding, the ultrasonic welding, pseudo bonding, such as hooking using a hole and a projection.

Figure 9:
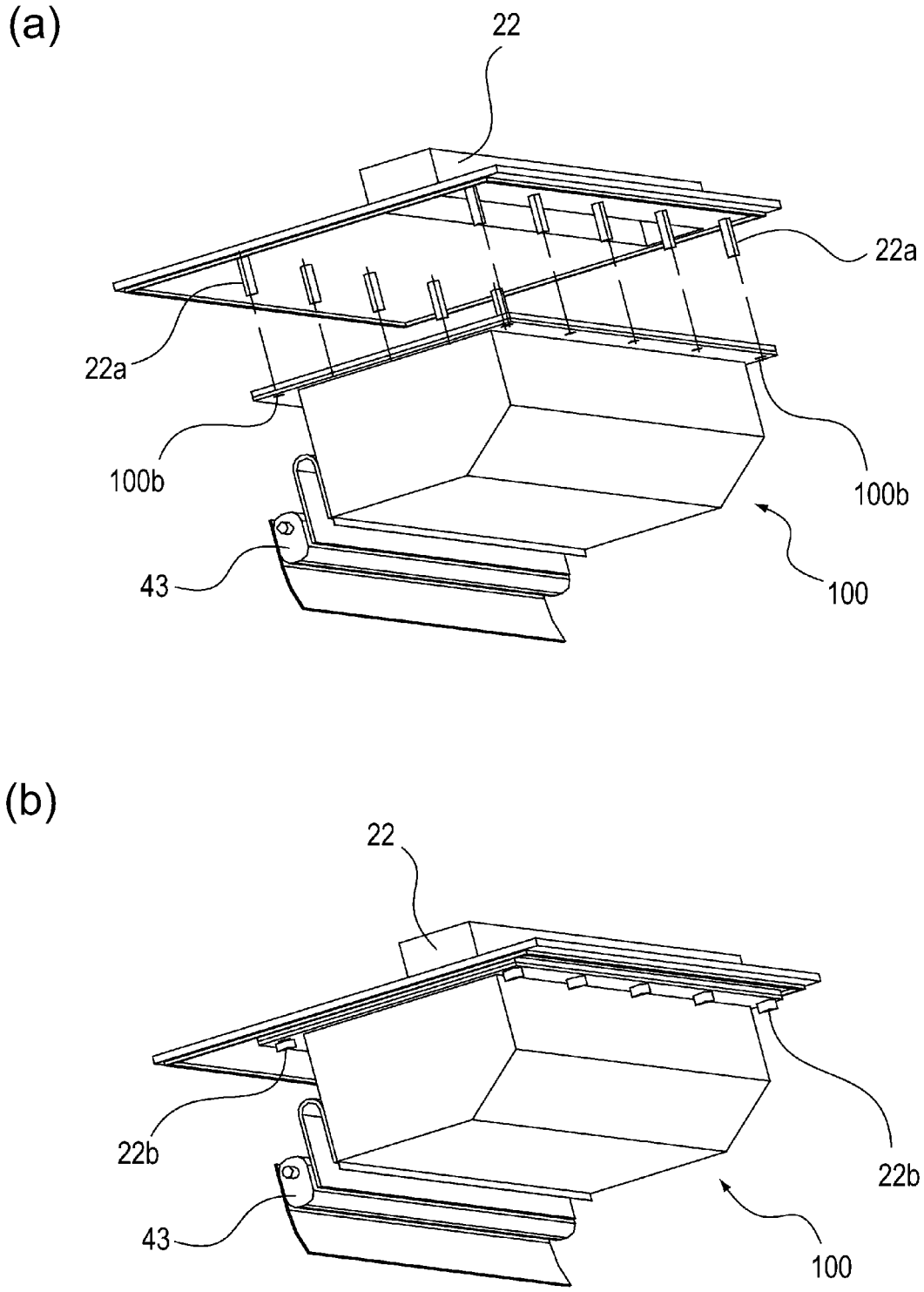
In FIGS. 9, (*a*) and (*b*) are an exploded perspective view and a perspective view, respectively, of the developer bag and a cover thereof.

In FIG. 9, (*a*) is an exploded perspective view of the developer bag 100 and the cover 22. As shown in (*a*) of FIG. 9, in the case where the developer bag 100 is fixed to the cover 22, a plurality of fixing bosses 22*a* are passed through the fixing holes 100*b*.

In FIG. 9, (*b*) is a perspective view showing a connected state of the developer bag 100 with the cover 22.

As shown in (*b*) of FIG. 9, free ends of the fixing bosses 22*a* are deformed by being heated and melted. As a result, by free end portions 22*b* each deformed and extended, the developer bag 100 is fixed to the cover 22.

The fixing method between the cover 22 and the developer bag 100 is not limited to the above-described method in this embodiment but may also be a method, such as the (thermal) welding, the bonding, the hooking using the hole and the projection. In this way, after the upper end of the developer bag 100 is fixed to the cover 22, as shown in FIG. 6, in the accommodating container 21, the developer bag 100 is accommodated.

Figure 10:
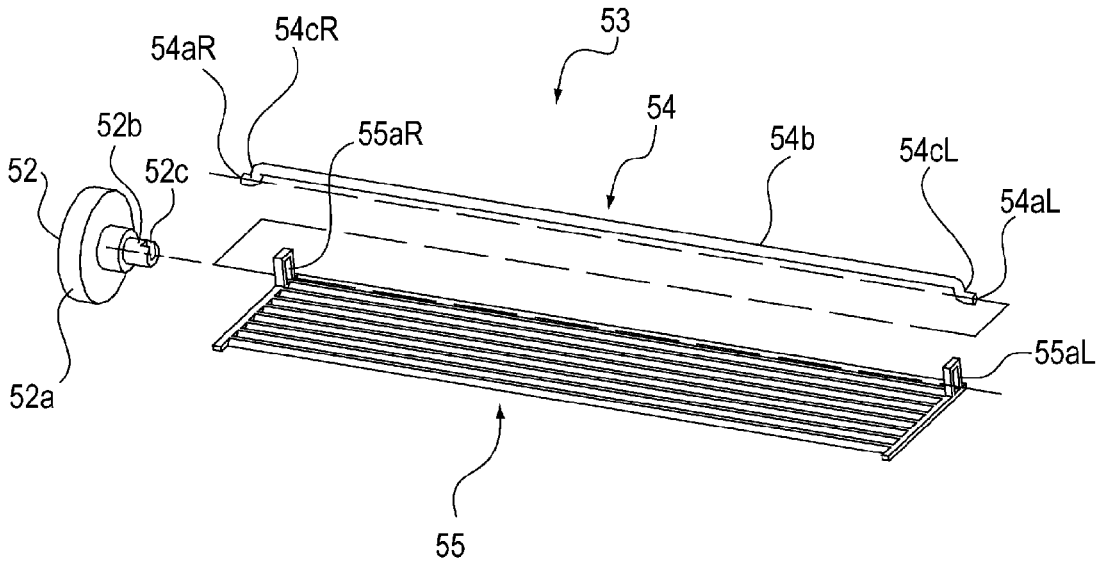
In FIGS. 10, (*a*) and (*b*) are exploded perspective views of a feeding member.
Figure 10:
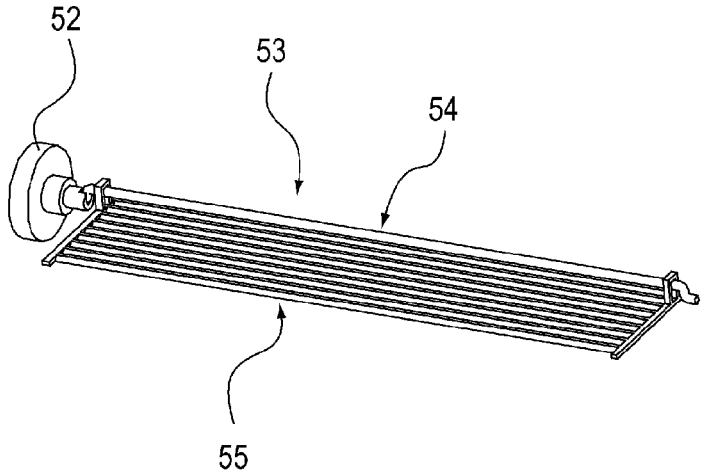

In FIG. 10, is an exploded perspective view of the feeding member 53. The swingable member 55 as a feeding member is disposed below the accommodating member 103 and between the accommodating member 103 and the accommodating container 21, and feeds the developer T. The swingable member 55 is constituted by a slider crank mechanism. The swingable member 55 is swung in a vertical direction and a horizontal direction. This will be specifically described below.

As shown in (*a*) of FIG. 10, the feeding member 53 includes the rotatable member 54 and the swingable member 55. The rotatable member 54 includes a shaft portion 54*a*R and a crank portion 54*c*R which are provided at an end portion in the driving side, a shaft portion 54*a*L and a crank portion 54*c*L which are provided at the other end portion in the non-driving side, and an engaging portion 54*b* provided between the crank portions 54*c*R and 54*c*L. Axes of the shaft portions 54*a*R and 54*a*L are aligned with each other, and a common axis of the shaft portions 54*a*R and 54*a*L and an axis of the engaging portion 54*b* are substantially parallel to each other.

Further, the crank portion 54*c*R is formed at angle of approximately 90 degrees relative to each of the shaft portion 54*a*R and the engaging portion 54*b*. Similarly, the crank portion 54*c*L is formed at an angle of approximately 90 degrees relative to each of the shaft portion 54*a*L and the engaging portion 54*b*. The swingable member 55 is provided with an opening 55*a*R at the end portion in the driving side and an opening 55*a*L at the other end portion in the non-driving side. Each of these openings 55*a*R and 55*a*L is formed inside a projected portion projected upward from the swingable member 55.

A method of assembling the rotatable member 54 with the swingable member 55 will be described. The shaft portion 54*a*L of the rotatable member 54 in the non-driving side is inserted into the opening 55*a*L of the swingable member 55. Then, the crank portion 54*c*L and the engaging portion 54*b* are inserted into the opening 55*a*L of the swingable member 55. Thereafter, the shaft portion 54*a*R and the crank portion 54*c*R of the rotatable member 54 in the driving side are inserted into the opening 55*a*R of the swingable member 55. In this way, the rotatable member 55 is assembled with the swingable member 55.

Then, the feeding member 53 is accommodated in the accommodating container 21 (FIG. 6). The shaft portion 54*a*R and the crank portion 54*c*R of the feeding member 53 after being accommodated are engaged with a groove portion 52*c* provided at a shaft portion 52*b* of the feeding gear 52 ((*b*)

of FIG. 10). On the other hand, the shaft portion 54*a*L is rotatably supported by the accommodating container 21. When the feeding gear 52 is rotated, the rotatable member 54 is rotated about the shaft portions 54*a*R and 54*a*L as a rotation shaft.

Figure 11:
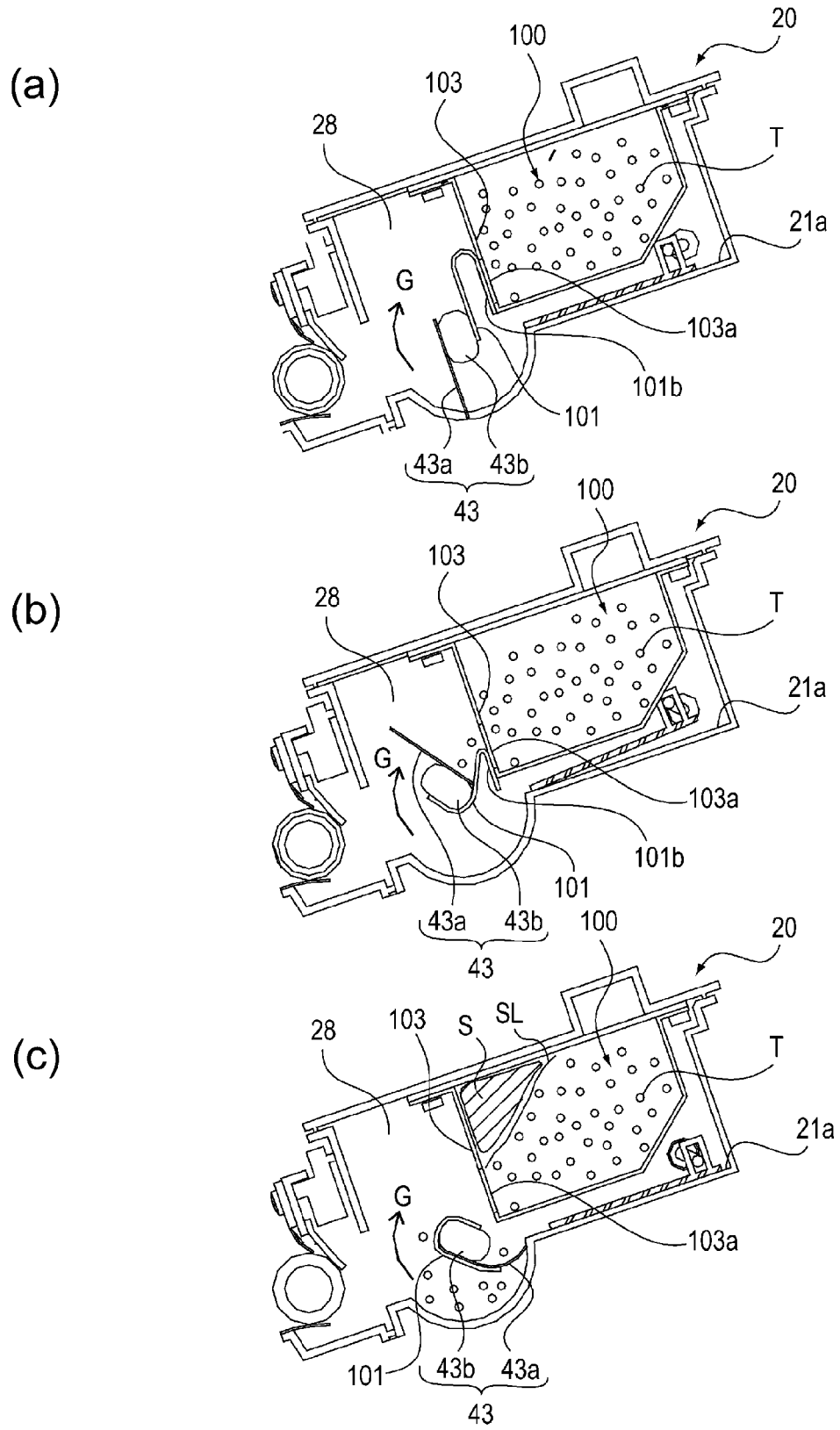
In FIG. 11, (*a*) to (*c*) are sectional views showing an unsealing process of the developer bag.

In FIG. 11, (*a*) to (*c*) are sectional views for illustrating an unsealing process of the developer bag 100.

In FIGS. 11, (*a*), (*b*) and (*c*) are sectional illustrations showing states of the developer bag 100 before, during and after the unsealing, respectively. As shown in FIG. 11, the developer bag 100, the seal member 101 and the actable member 43 are accommodated in the toner chamber 28. Incidentally, in a state in which the cartridge B is mounted in the apparatus main assembly A, an angle of the bottom 21*a* of the accommodating container 21 disposed below the accommodating member 103 is set so as to be smaller than an angle of repose of the developer T. When the cartridge B is mounted in the apparatus main assembly A, the driving force is transmitted from the apparatus main assembly A, and then the actable member 43 is rotated in an arrow G direction, so that the state thereof is changed from the state of (*a*) of FIG. 11 to the state of (*b*) of FIG. 11.

At this time, the sealing member 101 is wound up around the shaft 43*b* of the actable member 43, and at the same time, the welded portion between the sealing portion 101*b* and the accommodating member 103 is peeled, so that the discharge holes 103*a* of the accommodating member 103 are started to be exposed. Further, the sealing member 101 is completely wound up around the actable member 43 so as to change in state from the state of (*b*) of FIG. 11 to the state of (*c*) of FIG. 11, so that the discharge holes 103*a* are completely exposed. Thus, the developer T is subjected to the action of a component of a force acting in a direction of gravitation and therefore is discharged into the toner chamber 28 via the discharge holes 103*a* ((*c*) of FIG. 11).

As shown in (*c*) of FIG. 11, above the discharge holes 103*a* in the developer bag 100, a space S is created correspondingly to the amount of the discharged developer T. An interface between the space S and the developer T is taken as a boundary surface (line) SL. An angle of the boundary surface SL relative to the horizontal surface is set so as to be substantially equal to the angle of repose peculiar to the developer T.

Figure 12:
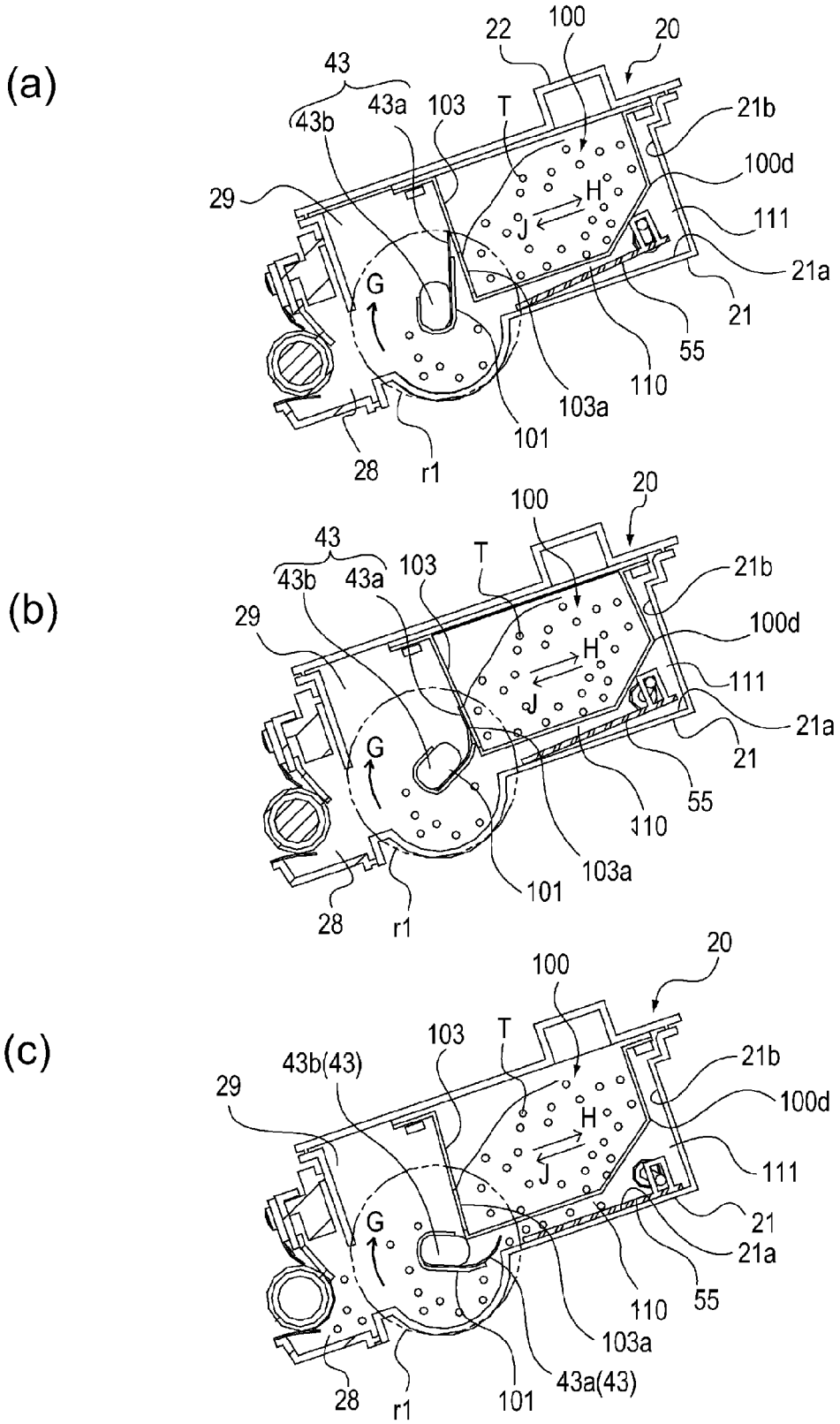
FIG. 12, (*a*) to (*c*) are sectional views, of a developing unit, for illustrating an operation of an actable member and the feeding member.

In FIG. 12, (*a*) to (*c*) are sectional views of the perspective view 20 for illustrating operations of the actable member 43 and the swingable member 55. The upper portion of the developer bag 100 is fixed to the cover 22 as the ceiling of the frame. For this reason, the upper portion of the accommodating member 103 is also fixed to the cover 22. As shown in (*a*) of FIG. 12, the actable member 43 is disposed inside the accommodating container 21 and the cover 22 and acts on the accommodating member 103 from the side of the discharge openings 103*a*. That is, the actable member 43 is rotated in an arrow G direction, so that the sheet member 43*a* contacts the developer bag 100. When the actable member 43 contacts the accommodating member 103 of the developer bag 100, the accommodating member 103 of the developer bag 100 is swung.

The actable member 43 has the functions of stirring and feeding the developer T. The actable member 43 includes the shaft 43*b* and the sheet member 43*a* mounted on the shaft 43*b*. The shaft 43*b* is formed of a rigid material such as PS, PC or POM, and the sheet member 43*a* is formed of a sheet-like flexible material such as PPS, PC or PET and carries out the stirring and feeding of the developer T.

As shown in (*b*) of FIG. 12, the actable member 43 is further rotated in the arrow G direction, so that the sheet member 43*a* and the sealing member 101 reaches an interfering region with the developer bag 100. Incidentally, a stirring radius of a free end of the sheet member 43*a* is shown by r1 in the figure. The sheet member 43*a* and the sealing member 101 contact the connecting portions 103*b* of the accommodating member 103 (FIG. 7).

As a result, the developer bag 100 receives an urging force from the urging portion 43*b* and the sheet member 43*a*.

Figure 14:
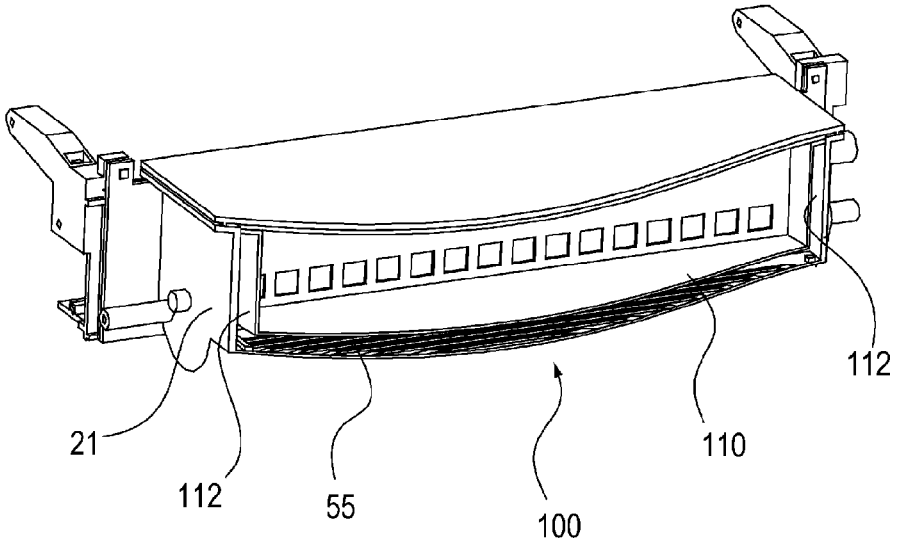
FIG. 14 is a perspective view of the developing unit from which a part thereof is cut away.

When the developer bag 100 is deformed in an arrow H direction, the developer T in the developer bag 100 and the developer T between the developer bag 100 and the accommodating container 21 are moved in the arrow H direction in FIG. 14. At the moment when the developer bag 100 is displaced in the arrow H direction to the maximum, a deformation speed becomes "0 (zero)". At this time, the force of inertia such that the developer T in the developer bag 100 is moved in the arrow H direction relative to the developer bag 100 acts on the developer T in the developer bag 100. As a result, the developer T in the developer bag 100 is loosened.

Immediately thereafter, with rotation of the actable member 43, the sheet member 43*a* and the developer bag 100 are spaced from each other. The urging force for urging the developer bag 100 by the sheet member 43*a* is removed (eliminated), so that by the self-weight of the developer T, the developer T below the developer bag 100 and the developer in the developer bag 100 are moved in an arrow J direction.

Thereafter, the developer bag 100 passes through the position of (*a*) of FIG. 12, and then as shown in (*c*) of FIG. 12, the sheet member 43*a* of the actable member 43 runs against the developer bag 100, so that the developer bag 100 is quickly decreased in speed. Thereafter, the sheet member 43*a* is restored to a position (of (*a*) of FIG. 12) before the sheet member 43*a* contacts the developer bag 100. At this time, by the quick decrease in speed, the force of inertia such that the developer T in the developer bag 100 is moved in the arrow J direction in the figures acts on the developer T in the developer bag 100.

The developer T in the developer bag 100 is gradually moved toward the discharge holes 103*a* by gravitation and the force in the arrow J direction in the figures due to the force of inertia.

The present inventor measured displacement, speed and acceleration of this swing motion of the developer bag 100 in an experiment, and confirmed that the above-described force of inertia acts on the developer T.

Figure 13:
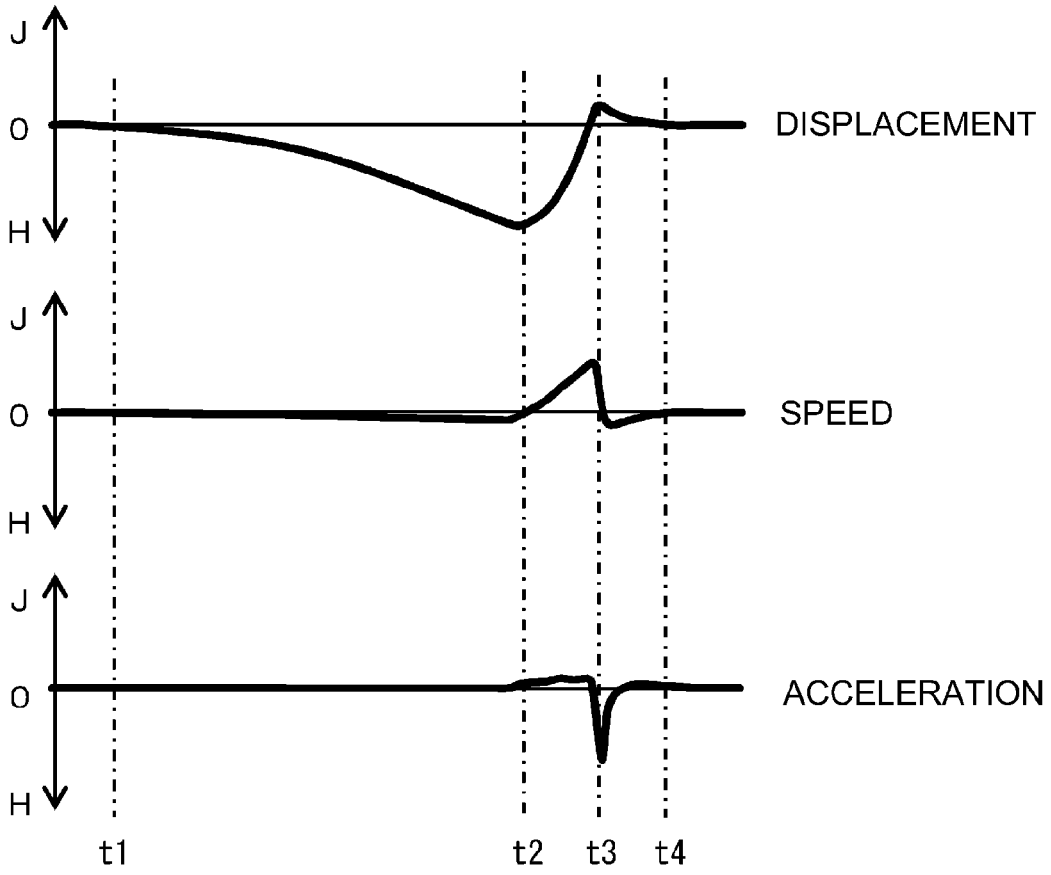
FIG. 13 includes graphs showing, with respect to arrow JH directions, a displacement of the developer bag with time, a deformation speed of the developer bag with time, and a deformation acceleration of the developer bag with time.

FIG. 13 includes graphs showing a relation of the displacement, deformation speed and deformation acceleration of the developer bag 100 with time progression with respect to the JH directions in FIG. 12. Incidentally, measurement was made by measuring the displacement of a measuring portion 100*d* (FIG. 12) of the developer bag 100 by using a laser displacement gage. In the graphs shown in FIG. 13, the ordinate represents the displacement, the speed and the acceleration from the above to the below, and the abscissa represents the time. A swing start time of the developer bag 100 is t1, a swing release (elimination) time is t2, a collision time is t3, and a complete stop time is t4. Further, the ordinate represents the arrow J direction directed upward and the arrow H direction directed downward.

At the swing start time t1, the actable member 43 starts the urging of the developer bag 100. After the swing release time t2, the acceleration in the arrow J direction in FIG. 12 is generated. At this time, the force of inertia acts on the developer T in the developer bag 100 in the arrow H direction in FIG. 12. Immediately before the collision time t3, the acceleration in the arrow J direction in FIG. 12 is generated, but is inverted into the arrow H direction at the moment of the collision. At this moment of the collision, the force of inertia acts on the developer T in the developer bag 100 in the arrow J direction opposite to the acceleration direction (arrow H direction in FIG. 12) of the developer bag 100. In this way, by the experiment, the force of inertia acting on the developer T from the contact of the sheet member 43*a* with the developer bag 100 until after the sheet member 43*a* was spaced from the developer bag 100 was able to be confirmed.

As described above, the developer bag 100 swings by contact (urging), spacing (separation) and collision between the developer bag 100 and the sheet member 43*a*. With the swing, the developer T in the developer bag 100 is satisfactorily loosened, and thereafter is gradually moved toward the discharge holes 103*a*.

The contact (urging), spacing and collision between the developer bag 100 and the sheet member 43*a* as the actable member 43 are periodically repeated during the transmission of the driving force to the process cartridge B. The above-described swing motion successively acts on the developer T, so that the developer T is satisfactorily discharged through the discharge holes 103*a*.

FIG. 14 is a perspective view showing the developing unit 20 which is partly cut away. As shown in FIG. 14, at each of sides of the developer bag 100, a side space portion 112 is provided with respect to the accommodating container 21. Between the developer bag 100 and the bottom 21*a* (FIG. 2) of the accommodating container 21, a lower space 110 is formed. Similarly, between the developer bag 100 and a rear surface 21*b* (FIG. 2) of the accommodating container 21, a rear space 111 (FIG. 2) is formed. For this reason, the developer bag 100 does not contact the accommodating container 21 and the swingable member 55, and therefore the swing and vibration of the developer bag 100 are not inhibited. Accordingly, a discharging effect of the developer T by the satisfactory swing and vibration of the developer bag 100 can be satisfactorily achieved.

The discharging step of the developer T will be further described with reference to (*c*) of FIG. 12. The developer T is discharged into the toner chamber 28 through the discharge holes (openings) 103*a*, and then is fed to the toner chamber 28 by the actable member 43.

When the developer T is stored in the toner chamber 28 to some extent, a feeding amount of the developer from the developer bag 100 is decreased, so that the amounts of the developer T in the developer bag 100, the toner chamber 28 and the developing chamber 25 are balanced with each other. Thereafter, when the developer T carried on the surface of the developing roller 32 is used, the developer T is fed from the developer bag 100 correspondingly to the amount of the use.

On the other hand, the developer T enters the lower space 110 between the developer bag 100 and the bottom 21*a* (FIG. 2) of the accommodating container 21. The bottom 21*a* of the accommodating container 21 is not designed so as to provide inclination (angle of repose) enough to permit drop of the developer T by its own weight. For that reason, the developer T entered the lower space 110 continuously stagnates in the lower space 110 without being consumed. Further, due to some cause, in the case where the sheet P remains in the feeding path in the apparatus main assembly A, a user taken out the cartridge B from the apparatus main assembly A in some cases. When the user taken out the cartridge B, there is also the case where the user holds the cartridge B in a state in which the cleaning unit 60 is directed upward and the developing unit 20 is directed downward, but also in such a case, the developer T enters the lower space 110.

Figure 15:
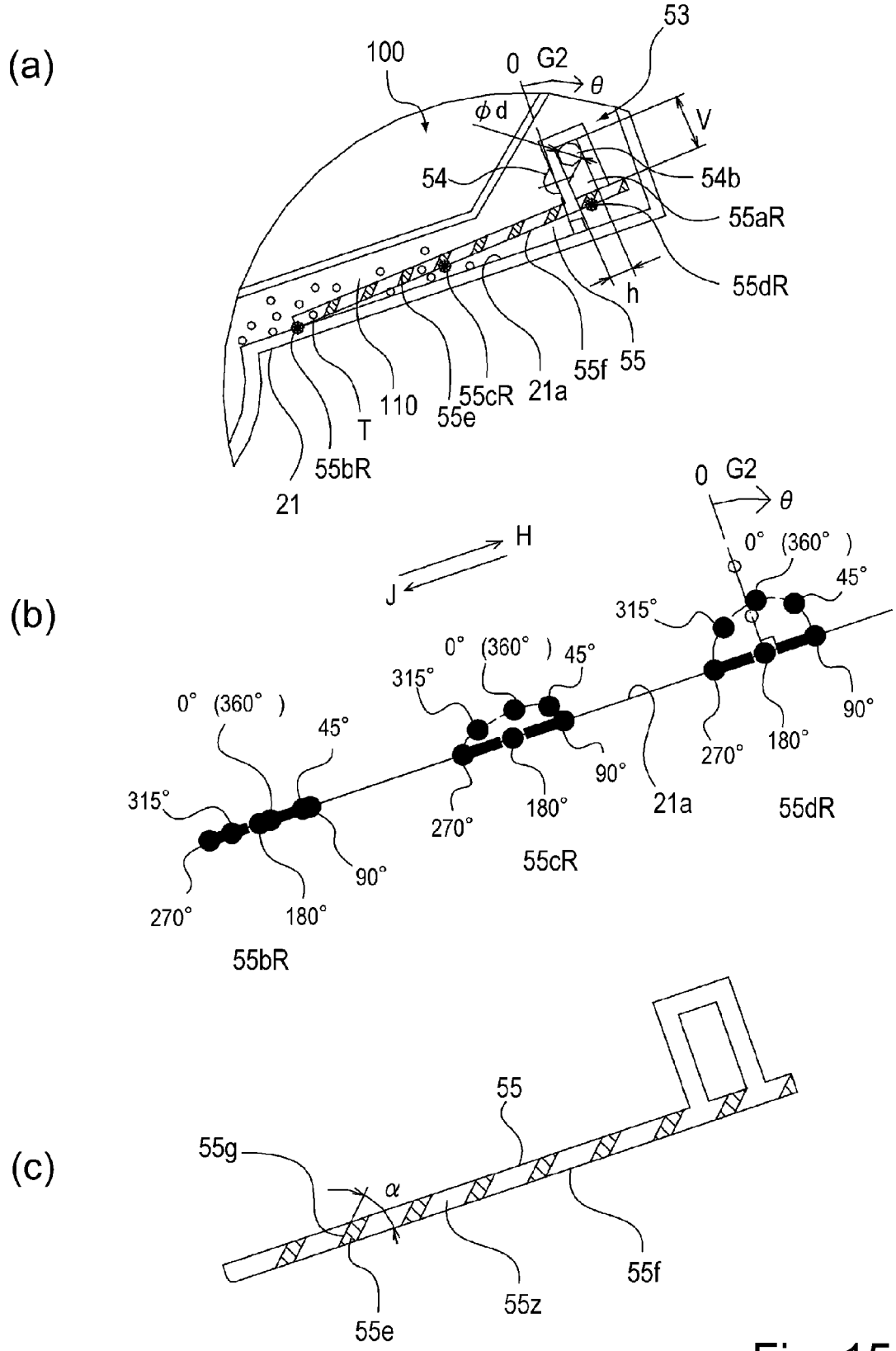
In FIG. 15, (*a*) to (*c*) are partly enlarged sectional views of the cartridge.

In FIG. 15, (*a*) is a partly enlarged sectional view of the cartridge B. As shown in (*a*) of FIG. 15, in the lower space 110, the feeding member 53 is disposed. Incidentally, (*a*) of FIG. 15 shows a structure in the driving side. The feeding member 53 includes the rotatable member 54 and the swingable member 55. When the rotatable member 54 is rotated about the shaft portions 54*a*R and 54*a*L (FIG. 10) in an arrow G2 direction, the engaging portion 54*b* is rotated in the arrow G2 direction.

Into the opening 55*a*R of the swingable member 55, the engaging portion 54*b* is inserted and engaged, and therefore the swingable member 55 moves in interrelation with the rotation of the rotatable member 54. This is true for the opening 55*a*L in the non-driving side. Incidentally, when the cross-section of the engaging portion 54 is ϕd in diameter, h in opening width, and v in height, in this embodiment, the substantially same dimension is provided with respect to a widthwise direction (i.e., h nearly equals to ϕd), and play is provided with respect to a height direction (i.e., v=ϕd+4 mm). A free end 55*b*R of the swingable member 55 contacts the bottom 21*a* of the accommodating container 21 by the self-weight of the swingable member 55. This is true for a free end 55*b*L in the non-driving side.

In FIG. 15, (*b*) is a schematic view showing a swing locus of the swingable member 55 interrelated with the rotation of the rotatable member 54. With respect to a rotational phase, the rotational phase of the rotatable member 54 is defined in (*a*) of FIG. 15. A rectilinear line which is perpendicular to the bottom 21*a* and which passes through a rotation shaft of the shaft portion 43*a*R is taken as a rotation basis (0 degrees), and a rotational angle from the basis in the arrow G2 direction is taken as θ.

With reference to representative points, description of motion of the swingable member 55 will be made by using three representative points on a lower surface 55*f* of the swingable member 55 with reference to (*a*) of FIG. 15. A free end is a free end portion 55*b*R, a portion immediately under the opening 55*a*R is a rear end portion 55*d*R, and a midpoint between the free end portion 55*b*R and the rear end portion 55*d*R is an intermediate portion 55*c*R. In the non-driving side, also a free end portion 55*b*L, a rear end portion 55*d*L and an intermediate portion 55*c*L are similarly defined. These three representative points 55*b*R, 55*c*R and 55*d*R are indicated as black dots. A broken line represents a locus through which the representing point of each of the free end portion 55*b*R, the intermediate portion 55*c*R and the rear end portion 55*d*R passes.

Positions of each representative point at 6 rotational phases of 0° (degrees), 45° (degrees), 90° (degrees), 180° (degrees), 270° (degrees) and 315° (degrees) are indicated by the black dots. The free end portion 55*b*R moves from beginning to end while sliding on the bottom 21*a*. The free end portion 55*b*R moves in the arrow H direction from 0° to 90°, and moves in the arrow J direction from 90° to 270°, and then moves in the arrow H direction from 270° to 360°) (0° to be returned to the original position (rotational angle).

The rear end portion 55*d*R is in a position spaced from the bottom 21*a* at 0°, and moves in the arrow H direction to 90° via 45°, and then lands on the bottom 21*a* at the time of 90°. Then, from 90° to 270° via 180°, the rear end portion 55*d*R moves in the arrow J direction while sliding on the bottom 21*a*. This is because the play is provided with respect to the height direction as described above. When the rotational phase exceeds 270°, the rear end portion 44*d*R is separated from the bottom 21*a* and then moves in the arrow H direction to 360° via 315°, thus being returned to the original position.

The intermediate portion 55*c*R moves along a locus, similarly as in the case of the rear end portion 55*d*R, such that the intermediary portion 55*c*R moves from the position spaced from the bottom 21*a*, and once lands on the bottom 21*a* and then is spaced from the bottom 21*a*.

The swingable member 55 is provided with a plurality of crosspiece-like feeding portions 55*e* extending from the driving side to the non-driving side. By movement of the swingable member 55 from 90° to 270° in the arrow J direction in parallel to the bottom 21*a*, the developer T entered the lower space 110 is fed in the arrow J direction by the feeding portions 55*e*.

Then, from 270° to 90° via 0°, the portions other than the free end portion 55*b*R are spaced from the bottom 21*a* and move in the arrow H direction. At this time, the feeding portions 55*e* are spaced from the bottom 21*a*, so that most of the developer T immediately above the bottom 21*a* is prevented from being fed in the arrow H direction.

In FIG. 15, (*c*) is sectional view of the swingable member 55. As shown in (*c*) of FIG. 15, the swingable member 55 is provided with the plurality of the feeding portions 55*e*. That is, each of the feeding portions 55*e* is formed in a rib shape, and a hole 55*z* is formed between adjacent two feeding portions 55*e*. Further, an angle α formed by a feeding surface 55*g* of the feeding portion 55*e* and a lower surface 55*f* of the swingable member 55 is set at 90° or less.

By this setting, when the swingable member 55 is deformed in the arrow J direction, the lower surface 55*f* is pressed against the bottom 21*a* (i.e., the lower surface 55*f* is prevented from being spaced from the bottom 21*a*) by resistance received from the developer T. Incidentally, the swingable member 55 is moved inside the lower space 110, and therefore does not contact the developer bag 100. As a result, a discharging property of the developer T obtained based on the swing and vibration of the developer bag 100 by the action of the actable member 43 is not adversely affected.

As described above, the swingable member 55 discharges the developer T which is discharged through the discharge holes 103*a* of the accommodating member 103 and which enters bottom the accommodating member 103, the accommodating container 21 and the cover 22. That is, the swingable member 55 causes the swing motion with friction and spacing as described above, so that the developer T entered the inside of the lower space 110 is discharged in the arrow J direction.

As a result, even in a constitution in which there is no sufficient inclination, of the bottom 21*a* of the accommodating container 21, for permitting the drop of the developer by the self-weight, the developer T entered the lower space 110 as a spacing between the developer bag 100 and the accommodating container 21 is discharged satisfactorily. As a result, the developer T in the developer bag 100 disposed inside the accommodating container 21 is used to the maximum, and therefore more images are formed.

[Embodiment 2]

Figure 16:
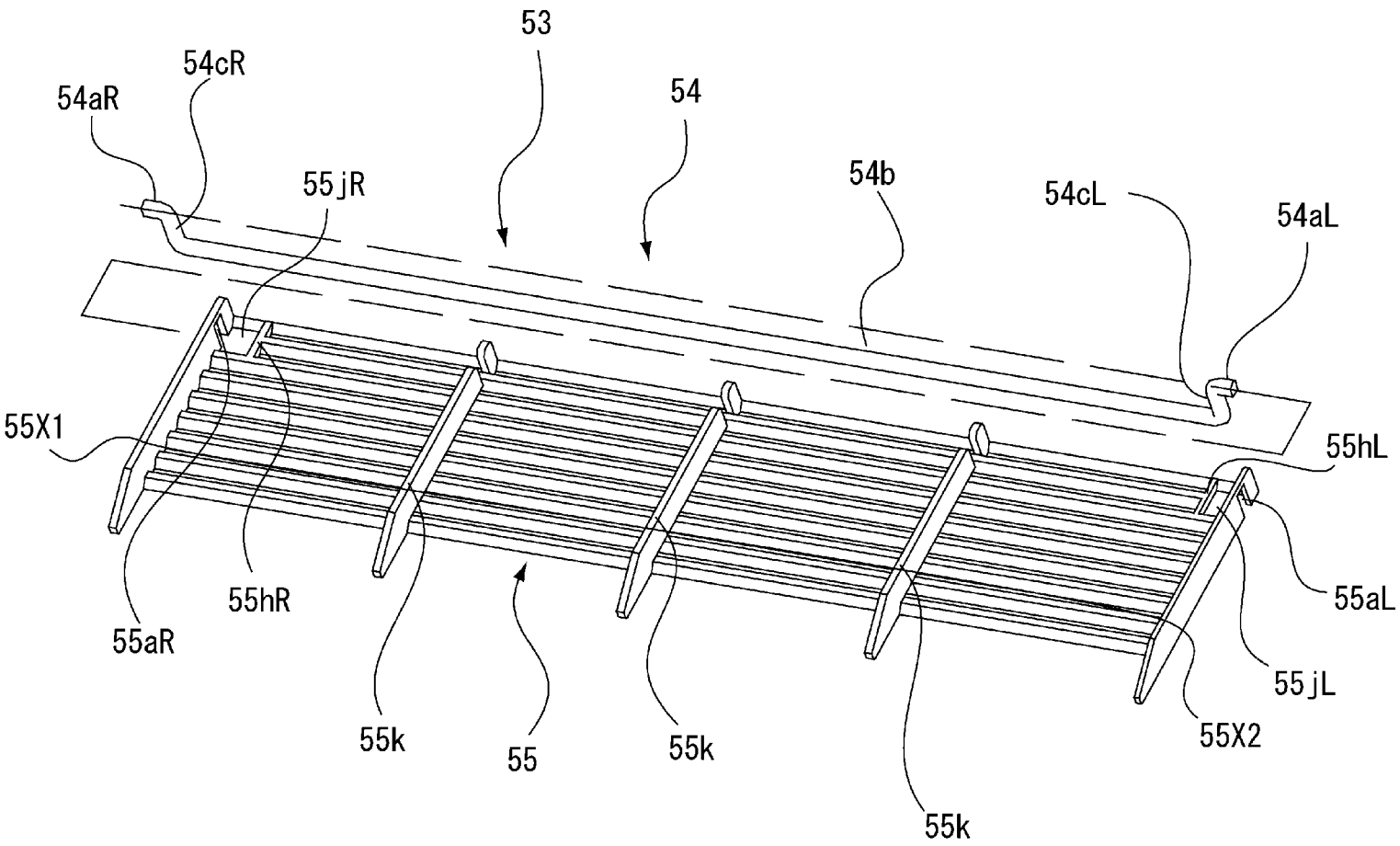
FIG. 16 is a perspective view of a feeding member used in an image forming apparatus in Embodiment 2.

FIG. 16 is a perspective view of a feeding member 53 used in an image forming apparatus in this embodiment. In this embodiment, constituent elements identical to those in Embodiment 1 are presented by the same reference numerals or symbols and will be omitted from description. The feeding member 53 includes the rotatable member 54 and the swingable member 55 similarly as in Embodiment 1. However, in this embodiment, the lengths of the crank portions 54*c*R and 54*c*L are set at values longer than those in the case of Embodiment 1. By the formation of the long crank portions 54*c*R and 54*c*L, the swingable member 55 is characterized in that the swingable member 55 periodically contacts the bottom 21*a* of the accommodating member 103. For this reason, an inclination angle of the bottom 121*a* of the accommodating member 103 is changed.

Further, in this embodiment, the swingable member 55 is provided with contact portions 55X1, 55*k* and 55X2 which are projected upward. Of these contact portions, the contact portions 55X1 and 55X2 are provided with cut-away openings 55*a*R and 55*a*L (cut-away portions), respectively, cut away downward. Further, the swingable member 55 is provided with space portions 55*j*R and 55*j*L so as to be continuous to the openings 55*a*R and 55*a*L, respectively, at positions adjacent to the contact portions 55X1 and 55X2, respectively, in a base end side. In this way, the openings 55*a*R and 55*a*L and the space portions 55*j*R and 55*j*L are formed, so that an insertion space when the rotatable member 54 is assembled with the swingable member 55 as shown in FIG. 16 by a broken line is ensured.

Lower side limitation of the rotatable member 54 is eliminated by providing the openings and the space portions in the actable member 55, and therefore lower-side limiting portions 55*h*R and 55*h*L are provided inside longitudinal ends of the actable member 55. The space portions 55*j*R and 55*j*L are provided between the opening 55*a*R and the lower-side limiting portion 55*h*R and between the opening 55*a*L and the lower-side limiting portion 55*h*L, respectively, and the long crank portions 54*c*R and 54*c*L are passed through the space portions 55*j*R and 55*j*L, respectively, so that the rotatable member 54 is assembled with the actable member 55.

Figure 17:
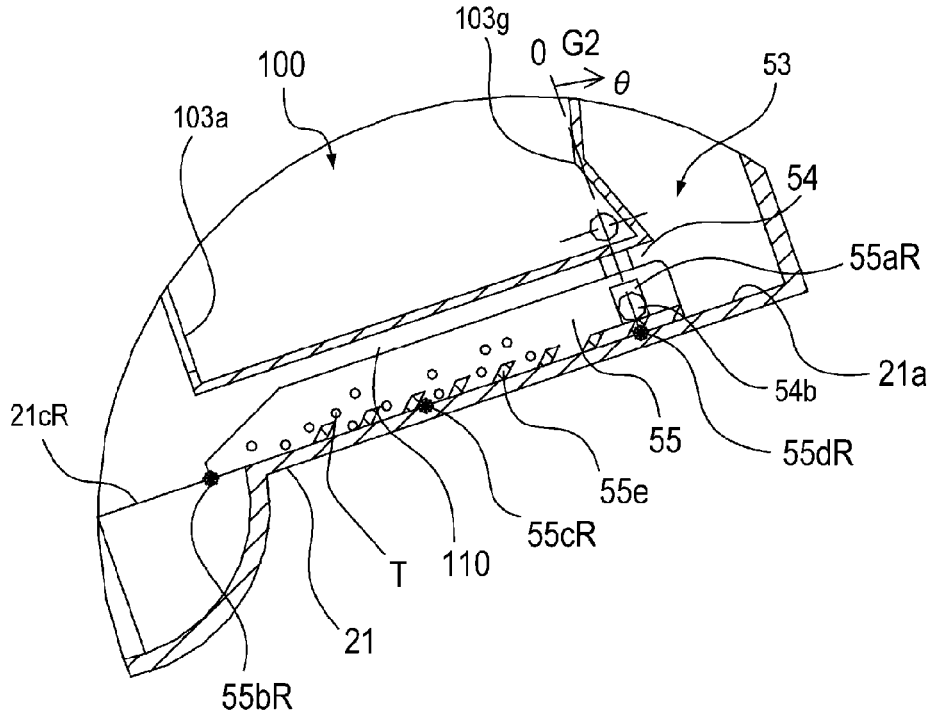
In FIGS. 17, (*a*) and (*b*) are partly enlarged sectional views of a cartridge.
Figure 17:
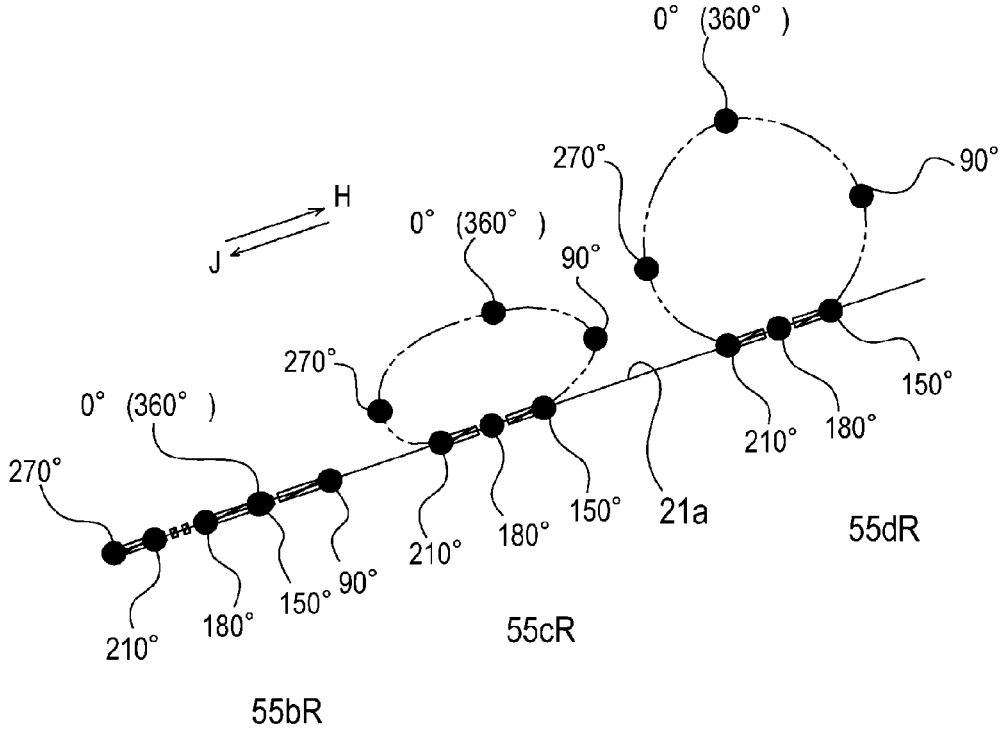

In FIG. 17, (*a*) is a partly enlarged sectional view of the cartridge B. As shown in (*a*) of FIG. 17, the rotatable member 54 is rotated in the arrow G2 direction by 180°. In this embodiment, the crank portions 54*c*R and 54*c*L are elongated, and a moving range of the swingable member 55 is enlarged, and therefore guide surface 21*c*R and a guide surface 21*c*L (not shown) are provided in alignment with the bottom 21*a* of the accommodating container 21.

In FIG. 17, (*b*) is a schematic view showing a locus of the swingable member 55 interrelated with the rotation of the rotatable member 54.

In (*b*) of FIG. 17, representative points of the swingable member 55 are a free end portion 55*b*R, an intermediate portion 55*c*R, and a rear end portion 55*d*R.

A chain double-dashed line represents a locus through which the representing point of each of the free end portion 55*b*R, the intermediate portion 55*c*R and the rear end portion 55*d*R passes.

Positions of each representative point at 6 rotational phases of 0° (degrees), 90° (degrees), 150° (degrees), 180° (degrees), 210° (degrees) and 270° (degrees) are indicated by the black dots. The free end portion 55*b*R moves from beginning to end while sliding on the bottom 21*a*.

The rear end portion 55*d*R is in a position spaced from the bottom 21*a* at 0°, and moves in the arrow H direction to 150° via 90°, and then lands on the bottom 21*a* at the time of 150°. Then, from 150° to 210° via 180°, the rear end portion 55*d*R moves in the arrow J direction while sliding on the bottom 21*a*. This is because the play is provided with respect to the height direction similarly as in Embodiment 1. When the rotational phase exceeds 210°, the rear end portion 44*d*R is separated from the bottom 21*a* and then moves in the arrow J direction to 270°. Then, from 270° to 360°) (0°, the rear end portion 55*d*R moves in the arrow H direction, thus being returned to the original position.

The intermediate portion 55*c*R moves along a locus, similarly as in the case of the rear end portion 55*d*R, such that the intermediary portion 55*c*R moves from the position spaced from the bottom 21*a*, and once lands on the bottom 21*a* and then is spaced from the bottom 21*a*. By movement of the swingable member 55 from 150° to 210° in the arrow J direction in parallel to the bottom 21*a*, the developer T entered the lower space 110 and being closest to the bottom 21*a* is fed in the arrow J direction by the feeding portions 55*e*. Further, from 90° to 150° and from 210° to 270°, the developer T immediately on the bottom 21*a* is fed in the arrow J direction by the feeding portions 55*e*. Then, from 270° to 90° via 0°, the portions other than the free end portion 55*b*R are spaced from the bottom 21*a* and move in the arrow H direction. At this time, the feeding portions 55*e* are spaced from the bottom 21*a*, so that most of the developer T in the neighborhood of the bottom 21*a* is prevented from being fed in the arrow H direction.

As described above, the developer T entered the lower space 110 by the swing motion with friction and spacing can be discharged in the arrow J direction by the above motion of the swingable member 55. As a result, even in a constitution in which there is no sufficient inclination, of the bottom of the developer accommodating container, for permitting the drop of the developer by the self-weight, the developer entered the spacing (the lower space 110) between the developer bag and the developer container can be satisfactorily discharged.

Figure 18:
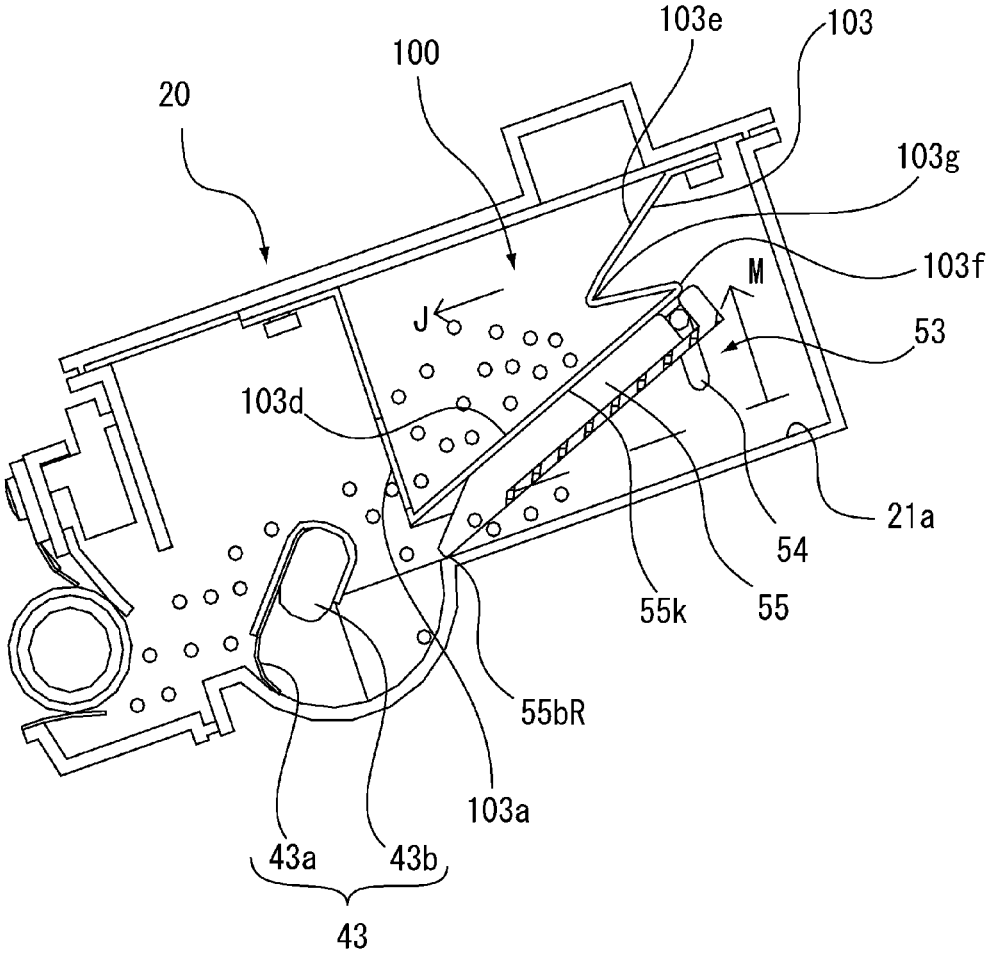
FIG. 18 is a sectional view of a cartridge in a modified embodiment of Embodiment 2.

FIG. 18 is a sectional view of the cartridge B in a modified embodiment in this embodiment. As shown in FIG. 18, the feeding member 53 is disposed in the lower space 110. FIG. 18 shows a state in which the rotational phase of the swingable member 55 is 0°. The swingable member 55 of the feeding member 53 is set so that portions other than the free end portion 55*b*R are spaced from the bottom 21*a* to the maximum.

The swingable member 55 is provided with a plurality of contact portions 55*k* extending in a direction perpendicular to the longitudinal direction (FIG. 16). The contact portions 55*k* contact the accommodating member 103, so that the bottom 103*d* is raised along the contact portions 55*k* in an arrow M direction. As a result, a degree of inclination of the bottom 103*d* is increased over from the discharge holes 103*a* side to the rear surface 103*e* side. Incidentally, in order to facilitate deformation of the accommodating member 103, at the rear surface 103*e*, a fold 103*g* is formed toward the inside of the accommodating member 103 (FIG. 17). The fold 103*g* extends in the longitudinal direction of the cartridge B. When the degree of inclination of the bottom 103*d* is increased, the developer in the developer bag 100 is moved in the arrow J direction and then is discharged through the discharge holes 103*a*.

As a result, even in the constitution in which there is no sufficient inclination, of the bottom 21*a* of the accommodating container 21, for permitting the drop of the developer by the self-weight, the developer T entered the lower space 110 as a spacing between the developer bag 100 and the accommodating container 21 is discharged satisfactorily. Further, by the increase in degree of inclination of the bottom 103*d*, the developer T in the developer bag 100 is satisfactorily discharged. As described above, more images can be formed by the developer T incorporated in the developer bag 100 in a limited amount.

Figure 19:
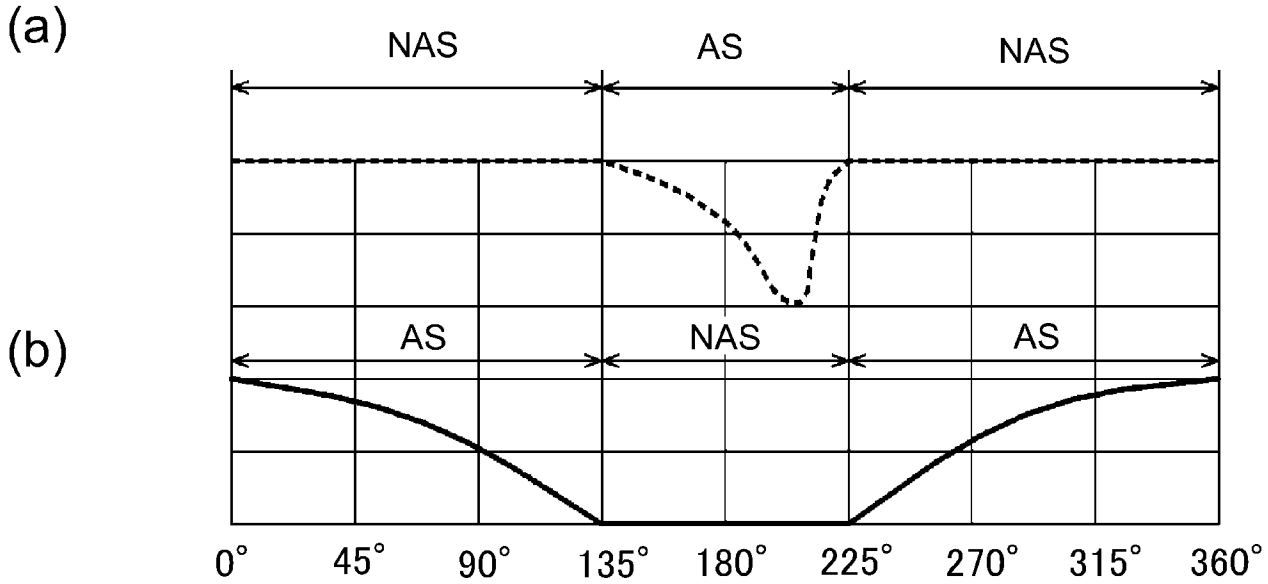
In FIGS. 19, (*a*) and (*b*) are timing charts showing a cooperation state between an actable member and a feeding member, in which (*a*) shows a movement actable member of an accommodating member in an arrow J direction by the actable member, and (*b*) shows a movement actable member of the accommodating member in an arrow M direction by the feeding member.

FIG. 19 is a graph showing timing of a cooperation state between the actable member 43 and the feeding member 53. An abscissa shows the rotational phase of the rotatable member 54 of the feeding member 53, and an ordinate shows an amount of each of the actable member 43 and the feeding member 53 which act on the accommodating member 103.

First, as shown in (*a*) of FIG. 19, the actable member 43 swings the accommodating member 43 in the arrow J and H directions (FIGS. 12 and 13). The graph of (*a*) of FIG. 19 shows a movement amount of a lower edge line 103*f* of the rear surface 103*e* in the arrow J direction. The actable member 43 acts on the accommodating member 103 at phases of 135° to 225° (acting section) but does not act on the accommodating member 103 at other phases (non-acting section). In the graph, the actable member 43 acts at a downward movement portion (J direction) but does not act at portions other than the downward movement portion.

Next, as shown in (*b*) of FIG. 19, the swingable member 55 swings the accommodating member 43 in the arrow member directions ((*b*) of FIG. 17 and FIG. 18). The graph of (*b*) of FIG. 19 shows a movement amount of a lower edge line 103*f* of the rear surface 103*e* in the arrow M direction. The swingable member 55 acts on the accommodating member 103 at phases of 0° to 135° and 225° to 360° (acting section) but does not act on the accommodating member 103 at other phases (non-acting section). In the graph, the swingable member 55 acts at a movement amount changing portion (M direction) but does not act at portions other than the movement amount changing portion.

This phenomenon will be further described specifically. The movement amount of the swingable member 55 in the arrow M direction becomes maximum at 0° and then that of the developer bag 100 in the arrow M direction is decreased. The swingable member 55 lands on the bottom 21*a* of the accommodating container 21 at the phase angle of 150°. The lower space 110 is ensured between the accommodating member 103 and the swingable member 55, and therefore the contact of the bottom 103*d* of the accommodating member 103 with the contact portions 55*k* of the swingable member 55 is eliminated at 135° in front of 150°. For that reason, the M direction movement amount becomes zero when the rotational phase is 135°. When the actable member 55 is further rotated, the accommodating member 103 is raised, but the actable member 55 contacts the accommodating member 103 at about 225° somewhat later than at the phase angle of 210° at which the actable member 55 is spaced from the bottom 21*a*, and then the M direction movement amount is increased until the phase angle reaches 360°) (0°.

That is, the swingable member 55 acts on the accommodating member in the sections in which the phase angles are 0° to 135° and 225° to 360°, but does not act on the accommodating member 103 at remaining phase angles of 135° to 225°. In this way, an acting section in which the sheet member 43*a* as a first actable member acts on the accommodating member 103 and an acting section in which the swingable member 55 as a second actable member acts on the accommodating member 103 do not overlap with each other. As a result, the swingable member 55 does not act on the developer bag 100 in a period in which the sheet member 43*a* acts on the accommodating member 103, and therefore the swing motion of the developer bag 100 and the inclination angle change are achieved to the maximum, so that the developer T is satisfactorily discharged through the discharge holes 103*a*.

[Embodiment 3]

Figure 20:
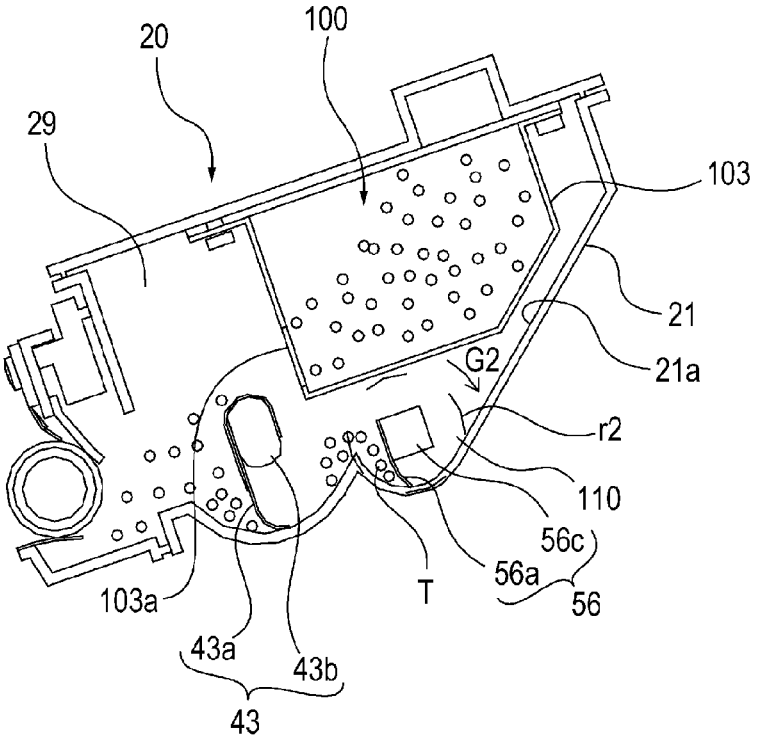
FIG. 20 is a sectional view of a cartridge in Embodiment 3.

FIG. 20 is a sectional view of a cartridge B in this embodiment. In this embodiment, constituent elements identical to those in Embodiments 1 and 2 are presented by the same reference numerals or symbols and will be omitted from description. Incidentally, Embodiment 3 corresponds to a modified embodiment of the feeding member in Embodiment 1. As shown in FIG. 20, a rotatable member 56 is rotatably supported by the accommodating container 21. The rotatable member 56 as the feeding member is provided below the accommodating member between the accommodating container 21 and the cover 22, and feeds the developer T.

A method of discharging the developer T from the lower space 110 in such a constitution will be described. The rotatable member 56 is constituted by a rotatable mechanism. The rotatable member 56 is rotatably supported by the driving side by the feeding gear 52 (FIG. 6) mounted to the accommodating container 21. As a result, the rotatable member 56 is rotated in the arrow G2 direction by the feeding gear 52 (FIG. 6) in the lower space 110 in the toner chamber 28.

The rotatable member 56 includes a shaft 56*c* and a sheet member 56*a* as a sheet mounted on the shaft 56*c*. The shaft 56*c* is formed of a rigid material such as PS, PC or POM. The sheet member 56*a* is formed of a flexible sheet material such as PPS, PC or PET.

A stirring radius of a free end of the sheet member 56*a* is represented by r2 in FIG. 20. When the rotatable member 56 is rotated, the free end of the sheet member 56*a* feeds the developer T entered the lower space 110 in a direction toward the actable member 43 while sliding on the bottom 21*a* of the accommodating container 21.

Incidentally, the free end of the sheet member 56*a* is set so as not to contact the developer bag 100. As a result, a discharging property of the developer T obtained based on the swing and vibration of the developer bag 100 by the actable member 43 is not adversely affected.

[Embodiment 4]

Figure 21:
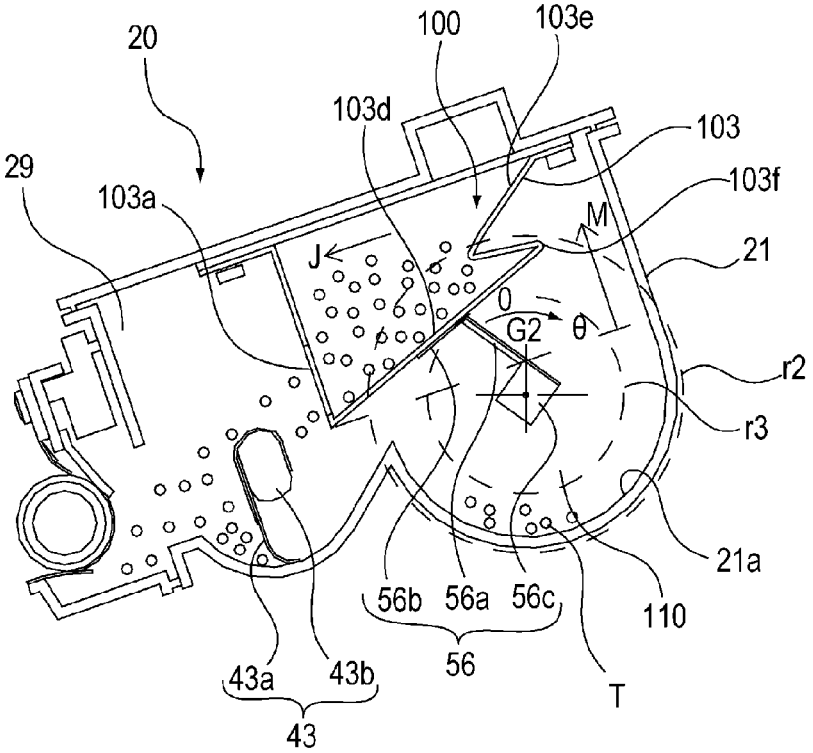
FIG. 21 is a sectional view of a cartridge in Embodiment 4.

FIG. 21 is a sectional view of a cartridge B in this embodiment. In this embodiment, constituent elements identical to those in Embodiments 1 to 3 are presented by the same reference numerals or symbols and will be omitted from description. Incidentally, Embodiment 4 corresponds to a modified embodiment of the rotatable member 56 in Embodiment 3. By the use of the rotatable member 56, an inclination angle of the bottom 103*d* of the developer bag 100 is changed.

The rotatable member 56 is rotated in the arrow G2 direction, and includes a contact portion 56*b* extended from the sheet member 56*a* in the radial direction. A rotation radius of a free end of the contact portion 56*b* is represented by r3 in FIG. 21. A rotation radius of a free end of the sheet member 56*a* is represented by r2 in FIG. 21.

When the rotatable member 56 is rotated, the free end of the sheet member 56*a* feeds the developer T entered the lower space 110 in a direction toward the actable member 43 while sliding on the bottom 21*a* of the accommodating container 21.

When the rotatable member 56 is further rotated, the contact portion 56*b* contacts the bottom 103*d*, and thus the bottom 103*d* is raised, so that the inclination angle of the bottom 103*d* is increased. Further, when the rotatable member 56 is rotated, a contact state between the contact portion 56*b* and the bottom 103*d* is eliminated.

When the inclination angle of the bottom 103*d* is increased, the developer T in the developer bag 100 is moved in the arrow J direction, thus being discharged through the discharge holes 103*a*. As a result, even in a constitution in which there is no sufficient inclination, of the bottom 21*a* of the accommodating container 21, for permitting the drop of the developer by the self-weight, the developer entered the spacing (the lower space 110) between the developer bag 100 and the accommodating container 21 can be satisfactorily discharged. Further, by increasing the inclination angle of the bottom 103*d*, the developer T in the developer bag 100 is satisfactorily discharged. As described above, more images can be formed by the developer T incorporated in the developer bag 100 in a limited amount.

Figure 22:
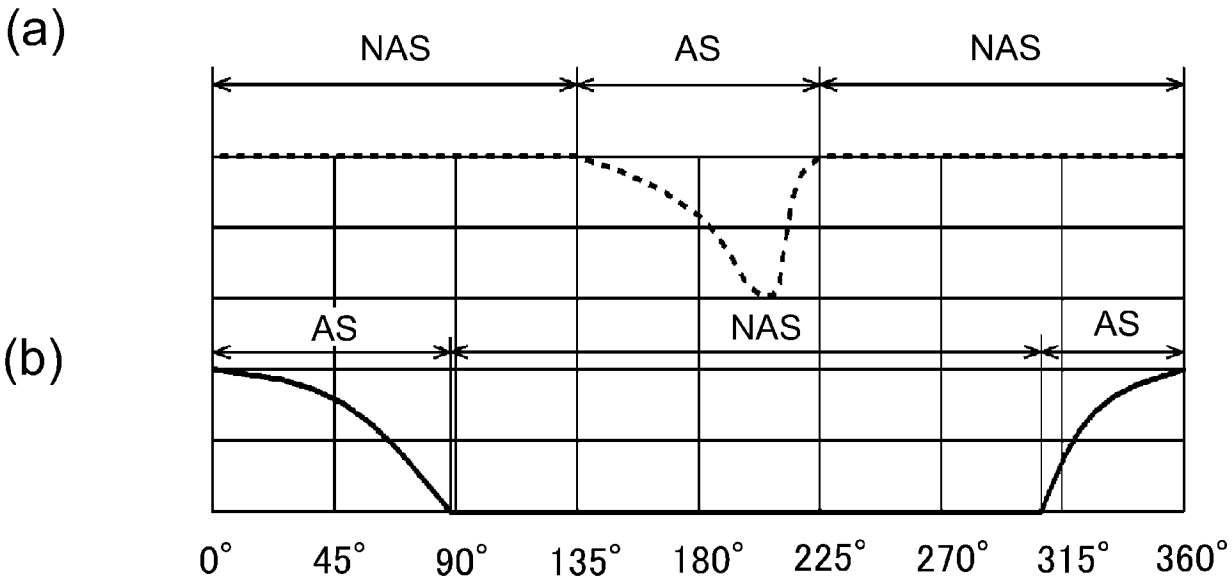
In FIGS. 22, (*a*) and (*b*) are timing charts showing a cooperation state between an actable member and a feeding member, in which (*a*) shows a movement actable member of an accommodating member in an arrow J direction by the actable member, and (*b*) shows a movement actable member of the accommodating member in an arrow M direction by the feeding member.

FIG. 22 is a graph showing timing of cooperation between the actable member 43 and the rotatable member 56 which act on the accommodating member 103.

In the graph of the actable member 43 in (*a*) of FIG. 22, the ordinate shows a movement amount of the actable member 43 in the arrow J direction, and the abscissa represents a rotational phase e in the non-acting section, the acting section and the non-acting section. A state of the rotational phase e (FIG. 21) of 0° corresponds to the state of FIG. 21. In this state of FIG. 21, the bottom 21*a* is located at a position where the bottom 21*a* has a maximum inclination angle.

The action of the actable member 43 will be described. The movement amount shown in FIG. 22 is the amount of movement of the lower edge line 103*f* of the rear surface 103*e* of the accommodating member 103 in the arrow J direction by the action of the sheet member 43*a* of the actable member 43 on the accommodating member 103 in FIG. 21. This corresponds to a broken line in FIG. 22. An acting phase is a section of 135° to 225°, and other phases mean a non-acting section.

In the graph of the rotatable member 56 in (*b*) of FIG. 22, the ordinate shows a movement amount of the lower edge line 103*f* of the rear surface 103*e* of the developer bag 100 in the arrow M direction, and the abscissa represents a rotational phase e in the non-acting section, the acting section and the non-acting section. In FIG. 21, the lower edge line 103*f* of the rear surface 103*e* of the developer bag 100 moves in the arrow M direction.

The action of the rotatable member 56 will be described. The movement amount shown in FIG. 22 is the amount of movement of the lower edge line 103*f* of the rear surface 103*e* of the accommodating member 103 in the arrow M direction by the action of the contact portion 56*b* of the rotatable member 56 on the accommodating member 103 in FIG. 21. This corresponds to a solid line in FIG. 22. An acting position is located in sections of 0° to 88° and 307° to 360°, and in a section of 88° to 307°, the rotatable member 56 does not act on the accommodating member 103. The actable member 43 and the rotatable member 56 are deviated in contact timing with the accommodating member 103 from each other. In this way, the acting section of the sheet member 43*a* of the actable member 43 acting on the accommodating member 103 and the acting section of the contact portion 56*b* of the rotatable member 56 acting on the accommodating member 103 do not overlap with each other. As a result, the rotatable member 56 does not act on the developer bag 100 in a period in which the sheet member 43*a* acts on the accommodating member 103, and therefore the swing motion of the developer bag 100 and the inclination angle change are achieved to the maximum, so that the developer T is satisfactorily discharged through the discharge holes 103*a*.

[Embodiment 5]

Figure 23:
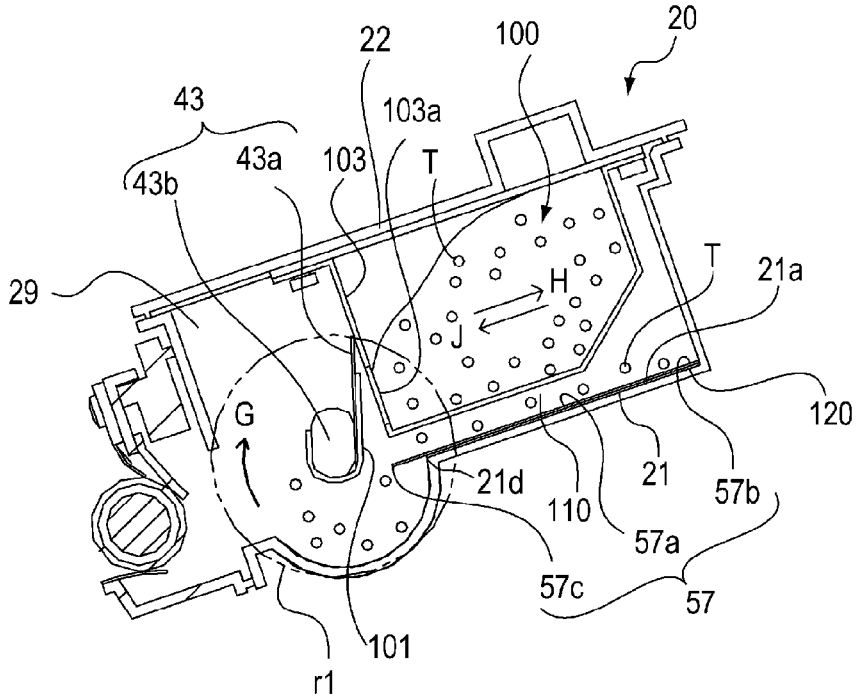
In FIGS. 23, (*a*) and (*b*) are sectional views of a cartridge in Embodiment 5.
Figure 23:
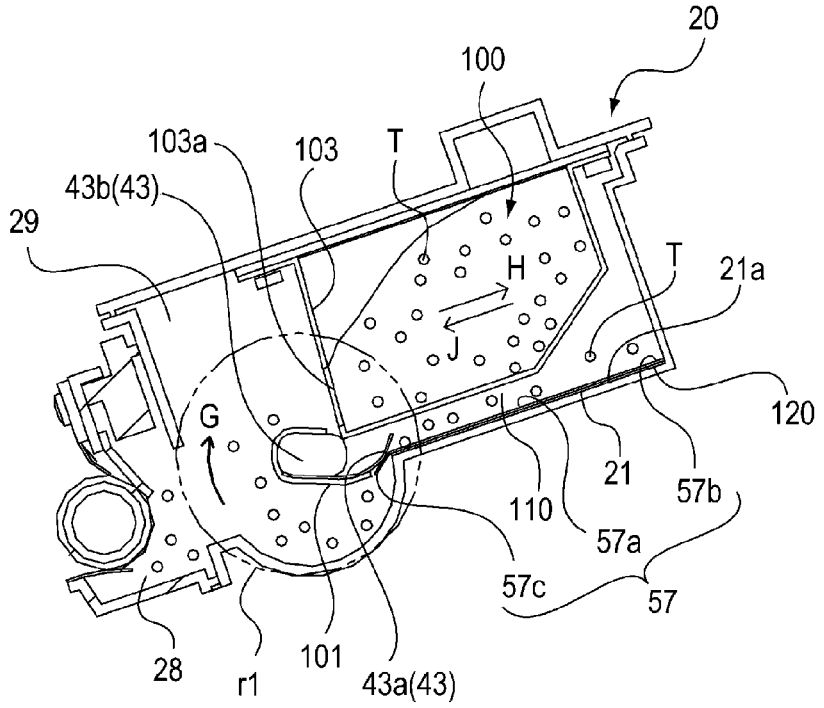

In FIGS. 22, (*a*) and (*b*) are sectional views of a cartridge B in this embodiment. In this embodiment, constituent elements identical to those in Embodiments 1 to 4 are presented by the same reference numerals or symbols and will be omitted from description. Incidentally, Embodiment 5 corresponds to a modified embodiment of the feeding member in Embodiment 1, in which a vibrating sheet is used. In this embodiment, as shown in FIG. 23, an elastic member 57 is rotatably provided in the accommodating container 21, and this elastic member 57 as the feeding member is provided in a space which is located between the accommodating container 21 and the cover 22 and which is positioned below the accommodating member 103, and feeds the developer T.

With reference to (*a*) of FIG. 23, a constitution in which the developer T is discharged from the lower space 110 will be described. The elastic member 57 is formed of polyethylene terephthalate in a thickness of 50 μm, and includes a movable portion 57*a* having a free end 57*c* and includes a fixing portion 57*b*. The fixing portion 57*b* is an end portion opposite from the free end 57*c* on the bottom 21*a* of the accommodating container 21 with respect to a toner (powder) discharging direction, and is fixed to the accommodating container 21. The movable portion 57*a* is a portion, other than the fixing portion 57*b*, where the portion is operable on the bottom 21*a* (floor surface) of the accommodating container 21.

A part of the movable portion 57*a* is projected into a rotation region of the actable member 43. That is, the elastic member 57 is disposed so that the free end region of the free end 57*c* enters the rotation region defined by a stirring radius r1 of a free end of the sheet member 43*a*. Here, the free end 57*c* of the elastic member 57 is set so as to be projected from an edge 21 by 4 mm. For this reason, in interrelation with rotation of the actable member 43, the movable portion 57*a* of the elastic member 57 is vibrated.

The elastic member 57 is fixed on the bottom 21*a* of the accommodating container 21 by a double-side tape 120 in the other side opposite from the free end 57*c* side. This portion is the fixing portion 57*b*. The fixing portion 57*b* is disposed upstream of the movable portion 57*a* with respect to the movement direction of the developer T. The double-side tape 120 used in this embodiment is 5 mm in width, and is disposed over a substantially whole area with respect to the longitudinal.

Next, with reference to (*b*) of FIG. 23, the constitution in which the developer T is discharged from the lower space 110 will be described. When the actable member 43 is rotated in an arrow G direction, the free end of the sheet member 43*a* interferes with the elastic member 57. At this time, the elastic member 57 is elastically deformed and then is restored to a planar shape after the sheet member 43 passes through the elastic member 57. At this time, the elastic member 57 repeats spacing and contact relative to the bottom 21*a* by the elastic deformation and shape restoration thereof.

Further, vibration of the elastic member 57 during the elastic deformation and shape restoration is transmitted to the developer T via the elastic member 57 in a range of the movable portion 57*a* ranging from the free end 57*c* to the fixing portion 57*b* of the elastic member 57. As a result, even when the angle of the bottom 21*a* is smaller than the angle of repose of the developer T, the developer T entered the lower space 110 slides and falls along the movable portion 57*a*, and is fed toward the actable member 43. In addition, by the repetition of the spacing and contact between the elastic member 57 and the bottom 21*a*, also the developer T entered between the elastic member 57 and the bottom 21*a* is fed toward the actable member 43.

Incidentally, a material for the elastic member 57 may be any of polyester, polyethylene terephthalate, polyacetal, polyphenylene sulfide, and cellulose. The elastic member 57 may have a thickness of 10 μm or more and 100 μm or less. Further, the fixing portion 57*b* may be fixed by a method, such as the double-side tape, thermal welding, an adhesive, a method in which a free end of a fixing boss is heated and welded (i.e., the fixing method between the developer bag 100 and the cover 22 described with reference to FIG. 9) or hooking using a hole and a projection.

According to any of other constitutions of Embodiments 1 to 5, in the case where the developer T enters between the accommodating member and the actable member 21 and the cover 22, the developer T is satisfactorily discharged through the discharge holes 103*a*. As a result, the developer in the developer bag 100 is used to the maximum. Thus, more images can be formed by the limited developer T.

According to the present invention, in the case where the developer enters between the flexible container and the frame, the developer is discharged satisfactorily.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 131850/2013 filed Jun. 24, 2013 and 050369/2014 filed Mar. 13, 2014, which are hereby incorporated by reference.

What is claimed is:

1. A cartridge detachably mountable to a main assembly of an image forming apparatus, said cartridge comprising:

a frame;

a flexible container, provided with an opening at a lateral side thereof and provided inside said frame, for accommodating developer; and a feeding member, provided below said flexible container and provided between said flexible container and said frame, for feeding the developer, wherein said feeding member is capable of contacting the developer and discharging the developer discharged through the opening of said flexible container from between said flexible container and said frame.

2. A cartridge according to claim 1, wherein, in a state in which said cartridge is mounted in the main assembly, an angle of a bottom of said frame disposed below said flexible container is set so as to be smaller than an angle of repose of the developer.

3. A cartridge according to claim 1, further comprising an actable member, provided inside said frame, actable on said flexible container from a side of the opening.

4. A cartridge according to claim 3, wherein an upper portion of said flexible container is fixed to a ceiling of said frame, and wherein, when said actable member contacts said flexible container, said flexible container is swung.

5. A cartridge according to claim 1, wherein said feeding member is swung in a vertical direction and in a horizontal direction.

6. A cartridge according to claim 5, wherein said feeding member is constituted by a slider crank mechanism.

7. A cartridge according to claim 1, wherein said feeding member is constituted by a rotatable mechanism.

8. A cartridge according to claim 7, wherein said feeding member includes a shaft and a sheet mounted on said shaft.

9. A cartridge according to claim 5, wherein said feeding member periodically contacts a bottom of said flexible container.

10. A cartridge according to claim 3, wherein said actable member and said feeding member contact said flexible container at different times.

11. A cartridge according to claim 3, wherein said feeding member includes a fixing portion, fixed to said frame, which is an end portion with respect to a direction opposite from a developer discharging direction on a bottom of said frame, and said feeding member includes a movable portion where a portion other than said fixing portion is operable on said bottom of said frame, wherein a part of said movable portion is projected into a rotation region of said actable member, and wherein said movable portion of said feeding member is vibrated in interrelation with rotation of said actable member.

12. A cartridge according to claim 1, wherein said bottom of said flexible container is such that a side remote from the opening is set at a height higher than a side close to the opening.

13. A process cartridge comprising:

a cartridge according to claim 1, wherein said cartridge includes an image bearing member.

14. A developing cartridge comprising:

a cartridge according to claim 1, wherein said cartridge includes a developer carrying member.

15. An image forming apparatus comprising:

a cartridge according to claim 1; and a main assembly.

* * * * *